US009564695B2

(12) United States Patent
Hammons et al.

(10) Patent No.: US 9,564,695 B2
(45) Date of Patent: Feb. 7, 2017

(54) TORQUE SLEEVE FOR USE WITH COAXIAL CABLE CONNECTOR

(71) Applicant: PerfectVision Manufacturing, Inc., Little Rock, AR (US)

(72) Inventors: Jeff G. Hammons, Little Rock, AR (US); Glen David Shaw, Conway, AR (US); Charles Darwin Davidson, Jr., Little Rock, AR (US)

(73) Assignee: PerfectVision Manufacturing, Inc., Little Rock, AR (US)

( * ) Notice: Subject to any disclaimer, the term of this patent is extended or adjusted under 35 U.S.C. 154(b) by 0 days.

(21) Appl. No.: 14/629,571

(22) Filed: Feb. 24, 2015

(65) Prior Publication Data

US 2016/0248178 A1 Aug. 25, 2016

(51) Int. Cl.
*H01R 9/05* (2006.01)

(52) U.S. Cl.
CPC ..... *H01R 9/0524* (2013.01)

(58) Field of Classification Search
CPC . H01R 13/622; H01R 2103/00; H01R 9/0521; H01R 9/0518
USPC ..... 439/320, 322, 578, 583, 585
See application file for complete search history.

(56) References Cited

U.S. PATENT DOCUMENTS

| | | | |
|---|---|---|---|
| D148,897 | S | 3/1948 | Ward |
| 2,757,351 | A | 7/1956 | Klostermann |
| D181,302 | S | 10/1957 | Logan |
| 2,858,358 | A | 10/1958 | Hawke |
| 3,184,706 | A | 5/1965 | Atkins |
| 3,199,061 | A | 8/1965 | Johnson et al. |
| 3,292,136 | A | 12/1966 | Somerset |
| 3,332,052 | A | 7/1967 | Rusinyak |
| 3,373,243 | A | 3/1968 | Janowiak |
| 3,375,485 | A | 3/1968 | Donohue et al. |
| 3,448,430 | A | 6/1969 | Kelly |
| 3,498,647 | A | 3/1970 | Schroder |
| 3,512,224 | A | 5/1970 | Newton |
| 3,522,576 | A | 8/1970 | Cairns |
| 3,537,065 | A | 10/1970 | Winston |
| 3,609,637 | A | 9/1971 | Cole |
| 3,665,371 | A | 5/1972 | Cripps |
| 3,668,612 | A | 6/1972 | Nepovim |
| 3,671,922 | A | 6/1972 | Zerlin |

(Continued)

FOREIGN PATENT DOCUMENTS

| | | |
|---|---|---|
| EP | 0542102 | 5/1993 |
| WO | WO9305547 | 3/1993 |

(Continued)

*Primary Examiner* — Thanh Tam Le
(74) *Attorney, Agent, or Firm* — Carmody Torrance Sandak & Hennessey LLP

(57) ABSTRACT

A torque sleeve for use on a coaxial cable connector that facilitates rotation of the coaxial connector onto an interface port is disclosed. The inner bore of the torque sleeve is dimensioned to allow the torque sleeve to fit over the back end cap of the coaxial connector and yet engage with the nut on the front of the coaxial connector. The torque sleeve may also have features to ensure that it stays in place over the coaxial connector and/or to promote continuity of grounding connection between the coaxial connector and interface port. The torque sleeve may be used for jumper cables, which possess a length of wire and two coaxial connectors.

34 Claims, 14 Drawing Sheets

(56) References Cited

U.S. PATENT DOCUMENTS

| | | | |
|---|---|---|---|
| 3,671,926 | A | 6/1972 | Zdenek |
| 3,678,445 | A | 7/1972 | Brancaleone |
| 3,678,446 | A | 7/1972 | Siebelist |
| 3,681,739 | A | 8/1972 | Kornick |
| 3,686,623 | A | 8/1972 | Nijman |
| 3,710,005 | A | 1/1973 | French |
| 3,739,076 | A | 6/1973 | Schwartz |
| 3,740,453 | A | 6/1973 | Callaghan |
| 3,835,442 | A | 9/1974 | Anderson |
| 3,835,443 | A | 9/1974 | Arnold |
| 3,846,738 | A | 11/1974 | Nepovim |
| 3,879,102 | A | 4/1975 | Horak |
| 3,976,352 | A | 8/1976 | Spinner |
| D241,341 | S | 9/1976 | Oxley |
| 3,985,418 | A | 10/1976 | Spinner |
| 3,986,737 | A | 10/1976 | Krusche |
| 4,106,839 | A | 8/1978 | Cooper |
| 4,128,293 | A | 12/1978 | Paoli |
| 4,173,385 | A | 11/1979 | Fenn |
| 4,280,749 | A | 7/1981 | Hemmer |
| 4,329,540 | A | 5/1982 | Howarth |
| 4,330,166 | A | 5/1982 | Cooper |
| 4,359,254 | A | 11/1982 | Gallusser |
| 4,423,919 | A | 1/1984 | Hillis |
| 4,426,127 | A | 1/1984 | Kubota |
| 4,525,000 | A | 6/1985 | Bachie |
| 4,531,805 | A | 7/1985 | Werth |
| 4,583,811 | A | 4/1986 | McMills |
| 4,593,964 | A | 6/1986 | Forney, Jr. |
| 4,630,806 | A | 12/1986 | Dan |
| 4,648,684 | A | 3/1987 | Mattis et al. |
| 4,684,201 | A | 8/1987 | Hutter |
| 4,698,028 | A | 10/1987 | Caro et al. |
| 4,703,988 | A | 11/1987 | Raux |
| 4,746,305 | A | 5/1988 | Nomura |
| RE32,787 | E | 11/1988 | Gallusser |
| 4,791,837 | A | 12/1988 | Main |
| 4,808,128 | A | 2/1989 | Werth |
| 4,813,716 | A | 3/1989 | Lalikos |
| 4,834,675 | A | 5/1989 | Samchisen |
| 4,936,788 | A | 6/1990 | Lin |
| 4,952,174 | A | 8/1990 | Sucht |
| D313,222 | S | 12/1990 | Takizawa |
| 4,979,911 | A | 12/1990 | Spencer |
| 4,990,106 | A | 2/1991 | Szegda |
| 5,002,503 | A | 3/1991 | Campbell |
| 5,011,422 | A | 4/1991 | Yeh |
| 5,024,606 | A | 6/1991 | Ming-Hwa |
| 5,043,696 | A | 8/1991 | Wang |
| 5,066,248 | A | 11/1991 | Gaver, Jr. |
| 5,078,623 | A | 1/1992 | Wang |
| 5,083,943 | A | 1/1992 | Tarrant |
| 5,088,936 | A | 2/1992 | Wang |
| 5,112,250 | A | 5/1992 | Wang |
| D327,872 | S | 7/1992 | McMills et al. |
| 5,167,525 | A | 12/1992 | Wang |
| 5,167,536 | A | 12/1992 | Wang |
| 5,192,226 | A | 3/1993 | Wang |
| 5,219,299 | A | 6/1993 | Wang |
| 5,226,838 | A | 7/1993 | Hsu |
| D339,568 | S | 9/1993 | Salz |
| 5,270,487 | A | 12/1993 | Sawamura |
| 5,297,458 | A | 3/1994 | Smith |
| 5,321,207 | A | 6/1994 | Huang |
| 5,340,325 | A | 8/1994 | Pai |
| 5,342,096 | A | 8/1994 | Bachle |
| 5,383,798 | A | 1/1995 | Lin |
| 5,387,116 | A | 2/1995 | Wang |
| 5,387,127 | A | 2/1995 | Wang |
| 5,389,012 | A | 2/1995 | Huang |
| 5,397,252 | A | 3/1995 | Wang |
| 5,413,502 | A | 5/1995 | Wang |
| 5,430,618 | A | 7/1995 | Huang |
| 5,438,251 | A | 8/1995 | Chen |
| 5,456,614 | A | 10/1995 | Szegda |
| 5,470,257 | A | 11/1995 | Szegda |
| 5,478,258 | A | 12/1995 | Wang |
| 5,498,175 | A | 3/1996 | Yeh |
| 5,599,198 | A | 2/1997 | Wang |
| 5,600,094 | A | 2/1997 | McCabe |
| 5,613,880 | A | 3/1997 | Wang |
| 5,632,651 | A | 5/1997 | Szegda |
| 5,667,409 | A | 9/1997 | Wang |
| 5,683,263 | A | 11/1997 | Hsu |
| 5,702,261 | A | 12/1997 | Wang |
| 5,722,856 | A | 3/1998 | Fuchs |
| 5,723,818 | A | 3/1998 | Yeh |
| 5,730,621 | A | 3/1998 | Wang |
| 5,769,652 | A | 6/1998 | Wider |
| D398,493 | S | 9/1998 | Jones |
| 5,803,757 | A | 9/1998 | Wang |
| 5,820,408 | A | 10/1998 | Wang |
| 5,863,226 | A | 1/1999 | Lan |
| 5,879,166 | A | 3/1999 | Wang |
| 5,879,191 | A | 3/1999 | Burris |
| 5,924,889 | A | 7/1999 | Wang |
| 5,934,137 | A | 8/1999 | Tarpill |
| 5,951,319 | A | 9/1999 | Lin |
| 5,957,730 | A | 9/1999 | Wang |
| 5,975,949 | A | 11/1999 | Holliday |
| 5,975,951 | A | 11/1999 | Burris |
| 5,980,308 | A | 11/1999 | Hu |
| 5,997,350 | A | 12/1999 | Burris |
| 6,024,588 | A | 2/2000 | Hsu |
| 6,065,976 | A | 5/2000 | Wang |
| 6,095,869 | A | 8/2000 | Wang |
| 6,113,431 | A | 9/2000 | Wang |
| 6,139,344 | A | 10/2000 | Wang |
| 6,146,197 | A | 11/2000 | Holliday |
| 6,153,830 | A | 11/2000 | Montena |
| 6,159,046 | A | 12/2000 | Wang |
| D436,076 | S | 1/2001 | Montena |
| 6,179,656 | B1 | 1/2001 | Wang |
| D437,826 | S | 2/2001 | Montena |
| D440,539 | S | 4/2001 | Montena |
| D440,939 | S | 4/2001 | Montena |
| 6,234,838 | B1 | 5/2001 | Wang |
| 6,276,970 | B1 | 8/2001 | Wang |
| 6,287,148 | B1 | 9/2001 | Huang |
| 6,332,815 | B1 | 12/2001 | Bruce |
| 6,386,912 | B1 | 5/2002 | Li |
| 6,390,840 | B1 | 5/2002 | Wang |
| D458,904 | S | 6/2002 | Montena |
| 6,402,155 | B2 | 6/2002 | Sakata |
| 6,406,330 | B2 | 6/2002 | Bruce |
| D460,739 | S | 7/2002 | Fox |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,478,599 | B1 | 11/2002 | Lee |
| 6,478,618 | B2 | 11/2002 | Wang |
| 6,488,317 | B1 | 12/2002 | Daoud |
| D468,696 | S | 1/2003 | Montena |
| 6,530,807 | B2 | 3/2003 | Rodrigues |
| 6,558,194 | B2 | 5/2003 | Montena |
| D475,975 | S | 6/2003 | Fox |
| D475,976 | S | 6/2003 | Montena |
| D475,977 | S | 6/2003 | Montena |
| 6,634,906 | B1 | 10/2003 | Yeh |
| 6,676,443 | B1 | 1/2004 | Wang |
| 6,716,062 | B1 | 4/2004 | Palinkas |
| 6,733,336 | B1 | 5/2004 | Montena |
| 6,767,247 | B2 | 7/2004 | Rodrigues |
| 6,767,248 | B1 | 7/2004 | Hung |
| 6,767,249 | B1 | 7/2004 | Li |
| 6,769,926 | B1 | 8/2004 | Montena |
| 6,776,650 | B2 | 8/2004 | Cheng |
| 6,776,657 | B1 | 8/2004 | Hung |
| 6,776,665 | B2 | 8/2004 | Huang |
| 6,780,052 | B2 | 8/2004 | Montena |
| 6,789,653 | B1 | 9/2004 | Hsu |

(56) References Cited

U.S. PATENT DOCUMENTS 6,793,526 B1 9/2004 Hsu
6,799,995 B2 10/2004 Hsu
6,805,584 B1 10/2004 Chen
6,817,897 B2 11/2004 Chee
6,830,479 B2 12/2004 Holliday
6,848,939 B2 2/2005 Stirling
6,848,940 B2 2/2005 Montena
6,860,751 B1 3/2005 Huang
D503,685 S 4/2005 Montena
D504,113 S 4/2005 Montena
D504,114 S 4/2005 Montena
D504,202 S 4/2005 Coutant
6,881,075 B2 4/2005 Huang
6,884,113 B1 4/2005 Montena
D505,391 S 5/2005 Rodrigues
6,887,090 B2 5/2005 Lin
6,887,102 B1 5/2005 Burris
D506,446 S 6/2005 Montena
6,908,337 B1 6/2005 Li
6,910,919 B1 6/2005 Hung
D507,242 S 7/2005 Montena
6,929,501 B2 8/2005 Huang
6,929,507 B2 8/2005 Lin
6,935,874 B1 8/2005 Fang
6,935,878 B2 8/2005 Hsu
6,948,969 B2 9/2005 Huang
6,948,973 B1 9/2005 Hsu
6,951,469 B1 10/2005 Lin
6,956,464 B2 10/2005 Wang
D511,497 S 11/2005 Murphy
D511,498 S 11/2005 Holliday
D512,024 S 11/2005 Murphy
D512,689 S 12/2005 Murphy
D513,406 S 1/2006 Rodrigues
D513,736 S 1/2006 Fox
D514,071 S 1/2006 Vahey
D515,037 S 2/2006 Fox
6,994,588 B2 2/2006 Montena
7,001,204 B1 2/2006 Lin
7,004,765 B2 2/2006 Hsu
7,004,777 B2 2/2006 Lien
7,008,263 B2 3/2006 Holland
7,018,235 B1 3/2006 Burris
D518,772 S 4/2006 Fox
D519,076 S 4/2006 Fox
D519,451 S 4/2006 Fox
D519,452 S 4/2006 Rodrigues
D519,453 S 4/2006 Rodrigues
D519,463 S 4/2006 Tamezana
7,021,965 B1 4/2006 Montena
D521,454 S 5/2006 Murphy
D521,930 S 5/2006 Fox
7,063,551 B1 6/2006 Lin
7,074,081 B2 7/2006 Hsia
7,114,990 B2 10/2006 Bence
7,118,416 B2 10/2006 Montena et al.
7,128,603 B2 10/2006 Burris
7,147,509 B1 12/2006 Burris
D535,259 S 1/2007 Rodrigues
7,182,639 B2 2/2007 Burris
7,191,687 B1 3/2007 Wadsley
7,192,308 B2 3/2007 Rodrigues
D543,948 S 6/2007 Montena
D544,837 S 6/2007 Disbennett
7,241,172 B2 7/2007 Rodrigues
7,252,546 B1 8/2007 Holland
7,255,598 B2 8/2007 Montena
7,288,002 B2 10/2007 Rodrigues
7,303,436 B1 12/2007 Li
7,309,255 B2 12/2007 Rodrigues
7,364,462 B2 4/2008 Holland
7,371,113 B2 5/2008 Burris
7,479,035 B2 1/2009 Bence
7,507,117 B2 3/2009 Amidon
7,513,795 B1 4/2009 Shaw
7,544,094 B1 6/2009 Paglia
D601,966 S 10/2009 Shaw
D601,967 S 10/2009 Shaw
7,618,276 B2 * 11/2009 Paglia ..... H01R 43/24 439/322
D607,826 S 1/2010 Shaw
D607,827 S 1/2010 Shaw
D607,828 S 1/2010 Shaw
D607,829 S 1/2010 Shaw
D607,830 S 1/2010 Shaw
D608,294 S 1/2010 Shaw
7,753,705 B2 7/2010 Montena
7,824,216 B2 11/2010 Purdy
7,837,501 B2 11/2010 Youtsey
7,841,896 B2 11/2010 Shaw
7,845,976 B2 12/2010 Mathews
7,892,005 B2 2/2011 Haube
7,892,024 B1 2/2011 Chen
7,931,509 B2 4/2011 Shaw
7,946,199 B2 5/2011 Bradley
7,950,958 B2 5/2011 Mathews
7,955,126 B2 6/2011 Bence
7,997,930 B2 * 8/2011 Ehret ..... H01R 13/622 439/320
8,016,605 B2 * 9/2011 Montena ..... H01R 13/622 439/322
8,016,612 B2 * 9/2011 Burris ..... H01R 9/05 439/578
8,025,518 B2 9/2011 Burris
8,029,316 B2 10/2011 Snyder
8,062,064 B2 11/2011 Rodrigues
8,065,940 B2 11/2011 Wilson
8,075,338 B1 12/2011 Montena
8,157,589 B2 4/2012 Krenceski
8,167,611 B2 5/2012 Nakano
8,167,646 B1 5/2012 Mathews
8,172,611 B1 5/2012 Montena
8,192,237 B2 6/2012 Purdy
8,287,310 B2 10/2012 Burris
8,313,345 B2 11/2012 Purdy
8,313,353 B2 11/2012 Purdy
8,323,053 B2 12/2012 Montena
8,323,060 B2 12/2012 Purdy
8,342,879 B2 * 1/2013 Amidon ..... H01R 9/0518 439/320
8,366,481 B2 2/2013 Ehret
8,414,313 B2 4/2013 Rodrigues
8,444,433 B2 5/2013 Snyder
8,444,445 B2 * 5/2013 Amidon ..... H01R 9/0524 439/583
8,465,322 B2 * 6/2013 Purdy ..... H01R 9/0524 439/584
8,469,740 B2 6/2013 Ehret
8,475,205 B2 7/2013 Ehret
8,480,430 B2 7/2013 Ehret
8,480,431 B2 7/2013 Ehret
8,485,845 B2 7/2013 Ehret
8,490,525 B2 7/2013 Wilson
8,568,164 B2 10/2013 Ehret
8,568,167 B2 * 10/2013 Montena ..... H01R 9/0524 439/578
2,280,728 A1 4/2014 Streib
8,794,113 B2 8/2014 Maury
8,864,519 B2 * 10/2014 Wei ..... H01R 9/05 439/578
2002/0146935 A1 10/2002 Wong
2003/0092319 A1 5/2003 Hung
2003/0194902 A1 10/2003 Huang
2003/0236027 A1 12/2003 Wang
2004/0053533 A1 3/2004 Huang
2004/0067688 A1 4/2004 Cheng
2004/0077215 A1 4/2004 Palinkas
2004/0102095 A1 5/2004 Huang
2004/0147164 A1 7/2004 Li
2004/0171297 A1 9/2004 Hsu
2004/0171315 A1 9/2004 Liao
2004/0194585 A1 10/2004 Clark
2004/0224556 A1 11/2004 Qin

(56) References Cited

U.S. PATENT DOCUMENTS

| | | | |
|---|---|---|---|
| 2005/0009379 | A1 | 1/2005 | Huang |
| 2005/0020121 | A1 | 1/2005 | Lin |
| 2005/0032410 | A1 | 2/2005 | Huang |
| 2005/0070145 | A1 | 3/2005 | Huang |
| 2005/0075012 | A1 | 4/2005 | Hsu |
| 2005/0153587 | A1 | 7/2005 | Hsu |
| 2005/0159030 | A1 | 7/2005 | Hsu |
| 2005/0186852 | A1 | 8/2005 | Hsu |
| 2005/0186853 | A1 | 8/2005 | Hsu |
| 2005/0202690 | A1 | 9/2005 | Lien |
| 2005/0202699 | A1 | 9/2005 | Hsu |
| 2005/0233632 | A1 | 10/2005 | Hsu |
| 2005/0250357 | A1 | 11/2005 | Chen |
| 2005/0260894 | A1 | 11/2005 | Chen |
| 2006/0094300 | A1 | 5/2006 | Hsu |
| 2006/0110977 | A1 | 5/2006 | Matthews |
| 2006/0121753 | A1 | 6/2006 | Chiang |
| 2006/0121763 | A1 | 6/2006 | Chiang |
| 2006/0292926 | A1 | 12/2006 | Chee |
| 2008/0216611 | A1 | 9/2008 | Resnick |
| 2009/0098770 | A1 | 4/2009 | Bence |
| 2009/0163075 | A1 | 6/2009 | Blew |
| 2010/0081321 | A1 | 4/2010 | Malloy |
| 2010/0199813 | A1 | 8/2010 | Phillips |
| 2010/0317225 | A1 | 12/2010 | Montena et al. |
| 2011/0021072 | A1 | 1/2011 | Purdy |
| 2011/0086543 | A1 | 4/2011 | Alrutz |
| 2011/0097928 | A1 | 4/2011 | Burris et al. |
| 2011/0248801 | A1 | 10/2011 | Blake |
| 2011/0250789 | A1 | 10/2011 | Burris |
| 2012/0003869 | A1 | 1/2012 | Ehret |
| 2013/0130544 | A1 | 5/2013 | Wei |
| 2013/0171870 | A1 | 7/2013 | Chastain et al. |
| 2014/0004739 | A1 | 1/2014 | Ehret |
| 2014/0051285 | A1 | 2/2014 | Raley et al. |

FOREIGN PATENT DOCUMENTS

| | | |
|---|---|---|
| WO | WO9324973 | 12/1993 |
| WO | WO9620518 | 7/1996 |
| WO | WO9722162 | 6/1997 |
| WO | WO9965117 | 12/1999 |
| WO | WO9965118 | 12/1999 |
| WO | WO03096484 | 11/2003 |
| WO | WO2005083845 | 9/2005 |

* cited by examiner

TORQUE SLEEVE FOR USE WITH COAXIAL CABLE CONNECTOR

FIELD OF THE INVENTION

The present invention relates generally to coaxial cable connectors. More particularly, the present invention relates to a torque sleeve for use with a coaxial cable connector which may be used to facilitate threading of coaxial cable connectors to ports by hand.

BACKGROUND OF THE INVENTION

Popular cable television systems and satellite television receiving systems depend upon coaxial cable for distributing signals. As is known in the satellite TV arts, coaxial cable in such installations is terminated by F-connectors that threadably establish the necessary signal wiring connections. The F-connector forms a "male" connection portion that fits to a variety of ports forming the "female" portion of the connection.

F-connectors have numerous advantages over other known fittings, such as RCA, BNC, and PL-259 connectors, in that no soldering is needed for installation, and costs are reduced as parts are minimized. For example, with an F-connector, the center conductor of a properly prepared coaxial cable fitted to it forms the "male" portion of the receptacle connection, and no separate part is needed. A wide variety of F-connectors are known in the art, including the popular compression type connector that aids in rapid assembly and installation. Hundreds of such connectors are seen in U.S. Patent Class 439, particularly Subclass 548.

F-connectors include a tubular post designed to slide over coaxial cable dielectric material and under the braided outer conductor at the prepared end of the coaxial cable. The exposed, conductive braid is usually folded back over the cable jacket. The cable jacket and folded-back outer conductor extend generally around the outside of the tubular post and are typically coaxially received within the tubular connector. F-connectors also include a nut with internal threads. The nut is threaded unto an externally threaded port through rotation.

It is important to establish an effective electrical connection between the F-connector, the internal coaxial cable, and the terminal port. Proper installation techniques require adequate torquing of the nut. In other words, it is desired that the installer appropriately tighten the connector during installation. A dependable electrical grounding path must be established from the port, through the connector, to the outer conductor of the coaxial cable. Threaded F-connector nuts should be installed with a wrench to establish reasonable torque settings. Critical tightening of the F nut to the threaded port applies enough pressure to the internal components of the typical connector to establish a proper electrical ground path. When fully tightened, the head of the tubular post of the connector directly engages the edge of the outer conductor of the port, thereby making a direct electrical ground connection between the outer conductor of the port and the tubular post; in turn, the tubular post is engaged with the outer conductor of the coaxial cable completing the electrical path from the port to the outer conductor of the coaxial cable.

Many connector installations, however, are not properly completed. It is a simple fact in the satellite and cable television industries that many F-connectors are not appropriately tightened by the installer. Due to the fragile nature of some the electronic equipment involved, installers are sometimes hesitant to use a wrench to tighten the connector onto the port. Furthermore, often consumers will disconnect the connectors from the electronic equipment, for example when moving or replacing the electronic equipment, but consumers are not adequately trained or equipped to properly reconnect such connectors to the electronic equipment ports afterwards. Accordingly, the connectors may not be adequately tightened, and poor signal quality often results.

In the past, others have attempted to use coaxial connectors that avoid the need for wrenches or other tools used for tightening. For example, a torque wrench known as the "Wing Ding" is sold that is installed over the nut of the connector. The Wing Ding has a pair of opposing wings that allow a user greater leverage when hand tightening the connector to the port. However, the Wing Ding suffers from several flaws. First, it requires a user to constantly change his or her grip as the wings rotate. Second, the wings only provide a short area for fingers to grip. Third, the wings require a larger area for rotation making it more difficult to use when the port is located in a confined space.

Other attempts to produce more easily gripped and rotated grip aids have been made. For example, U.S. Pat. No. 6,716,062 to Palinkas et al. discloses a coaxial connector with a nut including a cylindrical outer skirt of constant outer diameter and a knurled gripping surface. U.S. Pat. No. 8,568,164 to Ehret et al. and U.S. Pat. Pub. 2014/0004739 A1 to Ehret et al. disclose a coaxial connector having an altered nut that allows engagement with a torque sleeve. However, all of these grip aids require the use of customized F-connectors. Specifically, none of these connectors use a standard hexagonal nut. It is highly disadvantageous to require the manufacture and stocking of a greater number and variety of versions of F-connectors. Use of specific connectors for special applications requires that an installer be supplied with a greater number of connector types, and that the installer be knowledgeable about the use and installation of each.

Accordingly, the present inventors have recognized a need to provide a torque sleeve that can be used over standard F-connectors. To do so, the present inventors recognized and solved a geometric problem. Specifically, one possible torque sleeve design would be similar to a socket wrench, i.e., a sleeve with a hexagonal inner bore that can engage with the nut. One such sleeve is disclosed in FIG. 15 of U.S. Pat. No. 7,147,508 to Burris et al. However, the present inventors discovered that such a sleeve is ineffective for use over standard F-connectors.

This is because it is preferable that the torque sleeve be assembled onto the coaxial connector from the back of the connector, i.e. the portion opposite the nut. This requires that at least a portion of the torque sleeve fit over the other outer parts of the coaxial connector such as the body and the end cap. However, the following problem was discovered by the inventors. A standard hexagonal nut has both a radius and an apothem for its outer dimension. A hexagon's radius is the distance from the center of the hexagon to one of its corners. This dimension can be designated "S." A hexagon's apothem is the distance from the center of a hexagon to the mid-point of one of its sides. This dimension can be designated "T." As a matter of geometry, T is less than S. In standard F-connectors, the body and the end cap have generally circular outer surfaces. Between the end cap and the body, there will exist a greatest radius that the torque sleeve will have to clear in order to get to the nut, which can be designated "R." In standard F-connectors, R is greater than T but less than S. Since R is greater than T, the inventors discovered that it is impossible to design a sleeve with a hexagonal inner bore that can clear the body and the end cap and still engage the nut.

Accordingly, it is an object of the present invention to provide a torque sleeve that can solve this geometric problem but still engage the nut to effectively rotate the nut, thereby threading it onto an interface port.

It is another object of the present invention to provide a torque sleeve that can be easily gripped and rotated by hand, increasing the amount of torque on the coaxial connector when hand tightening.

It is another object of the present invention to provide a torque sleeve that can be assembled into place over a coaxial connector prior to sale.

It is another object of the present invention to provide a torque sleeve that can improve electrical grounding continuity of a coaxial connector.

It is another object of the present invention to provide a torque sleeve with minimized exterior dimensions to allow it to fit into most port locations.

It is another object of the present invention to make attachment of a coaxial connector to a port easier in blind attachment situations.

It is another object of the present invention to provide tactile feedback of torque sleeve rotation and to ensure tight connector of the coaxial connector to the port.

It is another object of the present invention to allow forward pressure on the torque sleeve without the sleeve sliding off of the front of the nut of the coaxial connector and to prevent the sleeve from easily pulling back off the nut during disconnection of the coaxial connector from the port.

SUMMARY OF THE INVENTION

The present invention is directed to an apparatus comprising a torque sleeve configured to be disposed radially over a coaxial cable connector having (i) a body and an endcap with a maximal radius of R and (ii) an N-sided nut having N corners wherein the radius, S, of the N-sided nut is greater than R and the apothem, T, of the N-sided nut is less than R, wherein the torque sleeve comprises: a first end; a second end; an outer surface; and an inner surface defining a bore; wherein the bore, at least at the first end, has a radius of approximately R or greater than R for all points on the inner surface; wherein the bore, at least at the first end, has a radius of approximately S for at least N points on the inner surface; wherein the bore, at least at the first end, has a radius less than S for at least 2N points on the inner surface; and wherein the bore is configured to engage the corners of the N-sided nut such that the torque sleeve and the N-sided nut are rotatable together.

The term "approximately" used in the foregoing sentence's context referring to a dimension means that that the radius of the bore can be slightly greater or slightly less than the given dimension and/or within manufacturing tolerances as long as the sleeve can still be pushed over the end nut and body and will still engage with the nut corners. For example, the bore's radius can be slightly less than R, but the inherent resilience or malleability of the material can still allow the torque sleeve to fit over the end cap and body. Additionally, the bore's radius can be slightly less than or slightly more than S at the N points, but still be able to engage with the corners of the nut. Such dimensions are encompassed by the present invention.

The foregoing torque sleeve solves the geometric problem previously discussed because it can fit over the body and end cap, and still engage with at least the corners of the nut. However, the foregoing torque sleeve will not engage with the portions of the nut at or proximate to the midpoints of its sides because R is greater than T. It was surprisingly discovered by the present inventors that the torque sleeve can still be effective at rotating the nut even though it is not fully engaged with the entire periphery of the nut.

In a preferred embodiment of the invention, the torque sleeve is dimensioned to comply with the requirements described above in the following way. First, the bore of the torque sleeve is conceptualized having a circular inner surface at the first end creating a bore of approximately R. Then, N notches (where N is preferably six) are cut into the inner surface at positions that are spaced apart to correspond to the N corners of the nut. The notches are deep enough to make the radius of the bore approximately S at the deepest point of the notch. Thus, inner surface of the torque sleeve will take on a cross-sectional shape that is circular except for the N notches. Obviously, it is not practical to construct such a torque sleeve by first creating a circular cross-section and then cutting out N notches. In practice, a mold can be made incorporating these features. A "notch" as that term is used herein may be V shaped or may be rounded or any other shape capable of engaging the nut of a coaxial connector.

The present invention is also directed to a coaxial connector assembled with the foregoing torque sleeve. The coaxial connector portion of the assembly comprises: a N-sided nut having N corners, a radius S, and an apothem T and being adapted to threadably fasten the connector; an elongated, hollow post comprising a portion that abuts the nut; a hollow, tubular body radially disposed over the post; and an end cap adapted to be coupled to the body; wherein the body and the end cap have a maximal radius R such that S is greater than R and T is less than R. The foregoing torque sleeve is then assembled over this coaxial connector and preferably can be designed to snap into place on the connector using features described hereafter.

The present invention is also directed to a method of using the foregoing coaxial connector and torque sleeve assembly to fasten the nut of the coaxial connector to an interface port. This method is performed by first providing the assembly previously described and then rotating the torque sleeve such that the bore of the torque sleeve engages the corners of the N-sided nut whereby the torque sleeve and the N-sided nut are rotatable together and the N-sided nut is threaded onto the interface port.

Other objects, advantages, and features of the invention will become apparent from the following detailed description, which, taken in conjunction with the drawings, discloses preferred embodiments of the present invention.

BRIEF DESCRIPTION OF THE DRAWINGS

A more complete appreciation of the preferred embodiments of the invention and many of its objects, advantages, and features will be understood by reference to the following detailed description when considered in conjunction with the accompanying drawings, wherein.

DETAILED DESCRIPTION OF THE INVENTION

Figure 1:
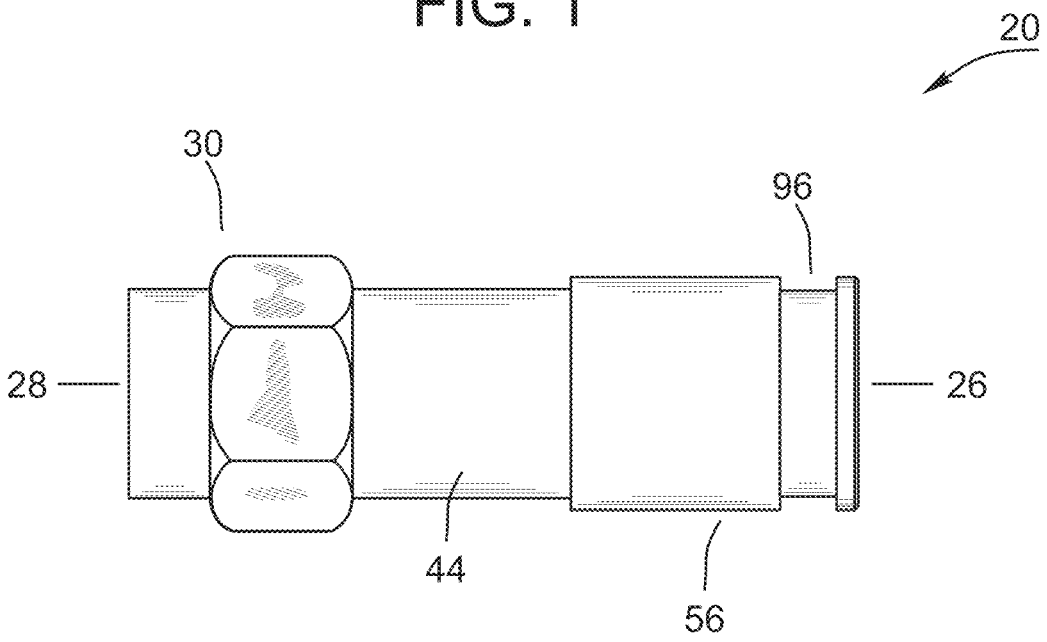
FIG. 1 is a longitudinal side view of a preferred connector, showing it in an uncompressed preassembly or "open" position without a torque sleeve.
Figure 2:
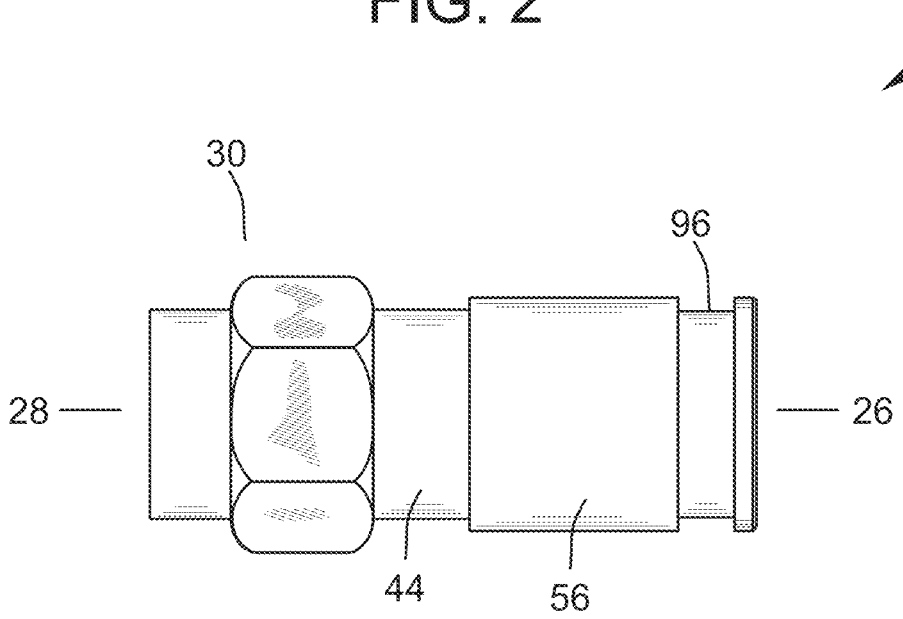
FIG. 2 is a longitudinal side view of the connector of FIG. 1, showing it in a "compressed" condition without a torque sleeve.
Figure 3:
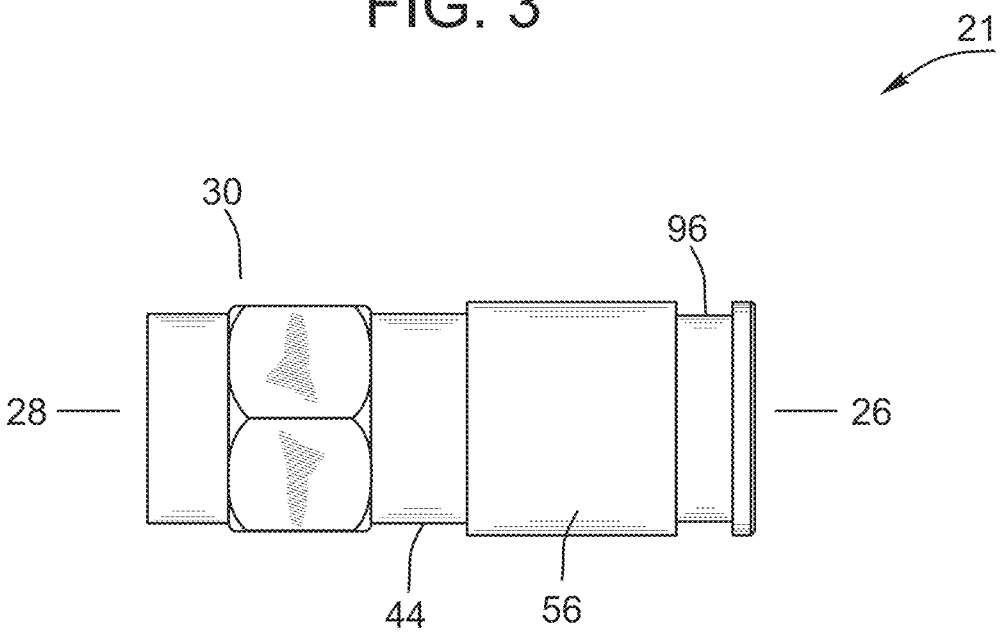
FIG. 3 is a longitudinal top plan view of the connector of FIG. 2.
Figure 4:
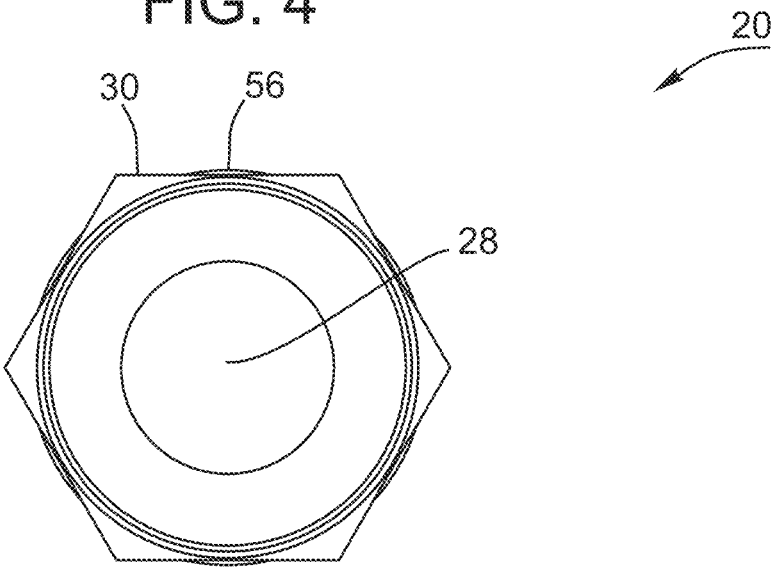
FIG. 4 is a front end view of the connector of FIG. 1.
Figure 5:
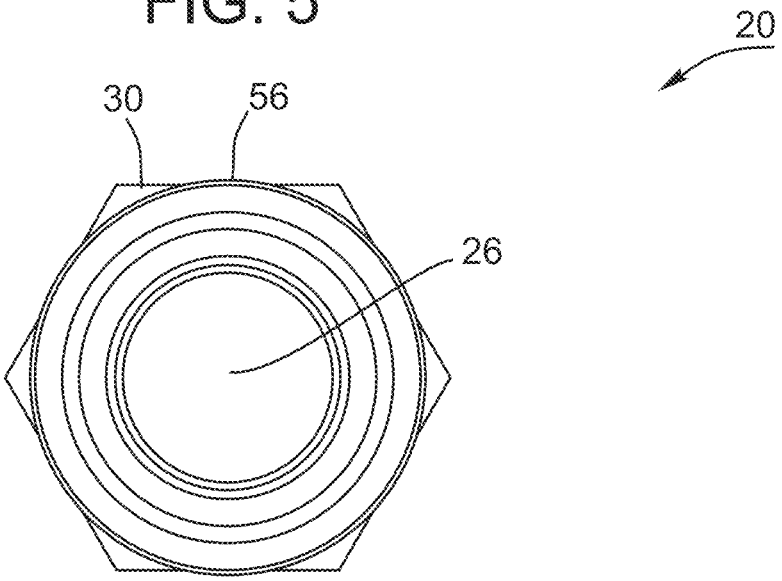
FIG. 5 is a rear end view of the connector of FIG. 1.
Figure 6:
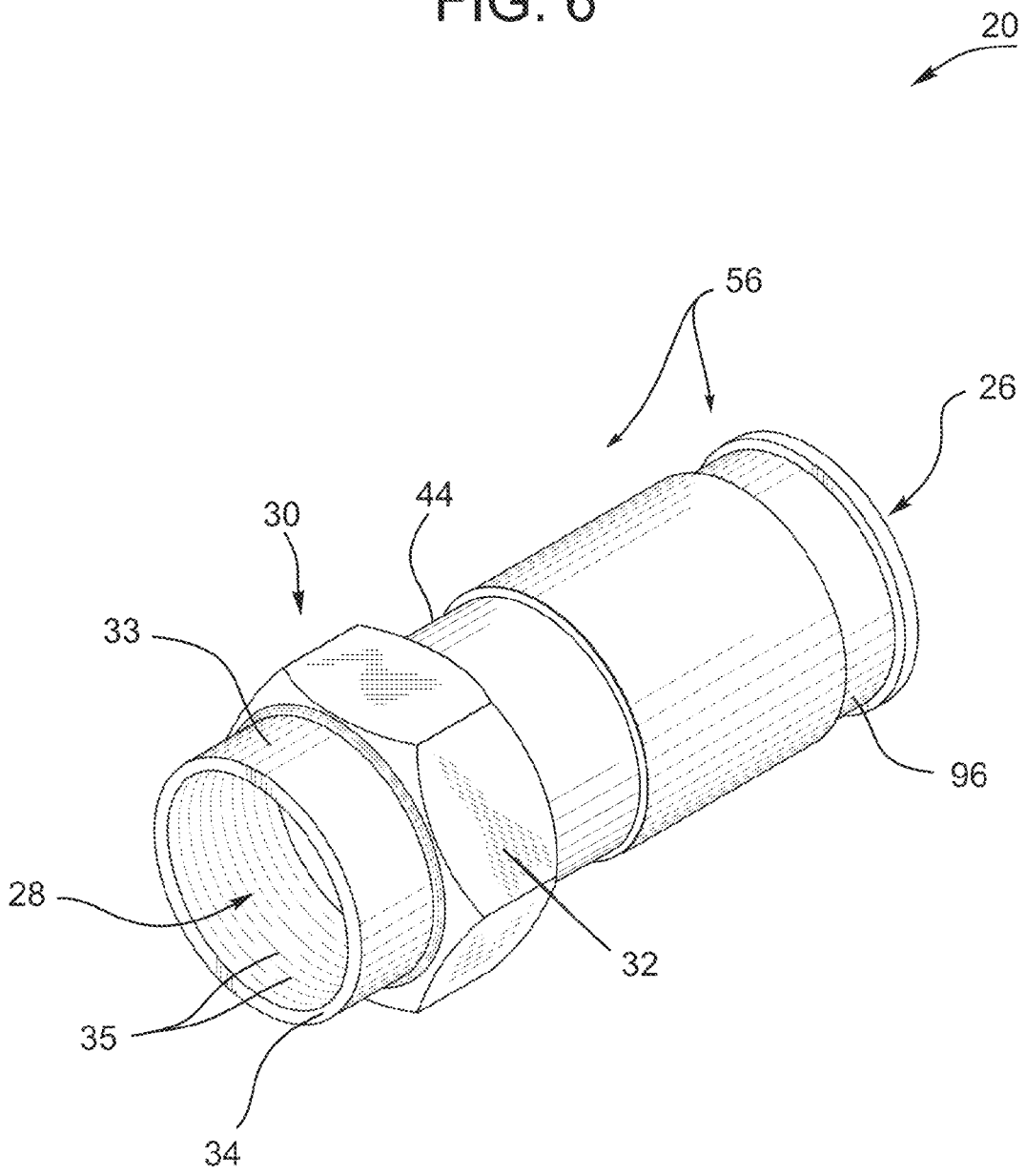
FIG. 6 is a longitudinal isometric view of a preferred connector similar to FIG. 1.
Figure 7:
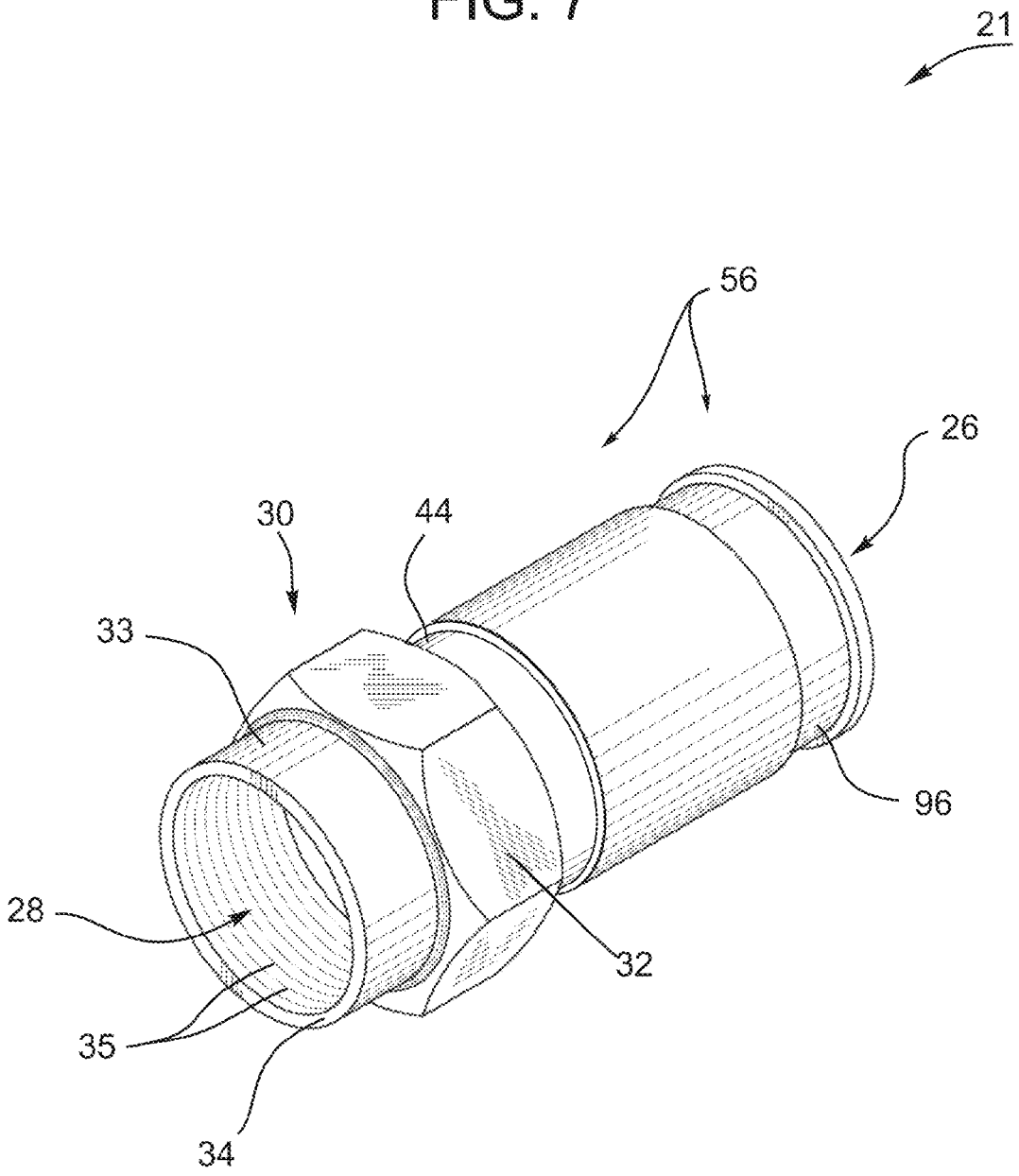
FIG. 7 is a longitudinal isometric view of a preferred connector similar to FIG. 2.

Reference will now be made in detail to the present preferred embodiment(s) of the invention. Whenever possible, the same reference numerals will be used throughout the drawings to refer to the same or like parts.

First, one preferred embodiment of a standard F-connector will be described, which is useable in conjunction with the hereinafter described torque sleeve.

With initial reference directed to FIGS. 1-16 of the appended drawings, an open F-connector for a coaxial cable constructed generally in accordance with the preferred embodiment of the invention has been generally designated by the reference numeral 20. The same connector disposed in a closed position is designated 21. Connectors 20 and 21 are adapted to terminate an end of properly prepared coaxial cable, the proper preparation of which is well recognized by installers and others with skill in the art. After a prepared end of coaxial cable 116 is properly inserted through the open bottom end 26 of an open connector 20, the connector may be placed within a suitable compression hand tool for compression, substantially assuming the closed configuration.

A preferred rigid, tubular, metallic nut 30 has an N-sided, preferably hexagonal, drive head 32 integral with a protruding, coaxial stem 33. As noted previously, the head 32 of the N-sided nut 30 has a radius S and an apothem T, with T being smaller than S as a matter of geometry. Conventional, internal threads 35 are defined in the nut or head interior for rotatable, threadable mating attachment to a suitably-threaded interface port. The open front mouth 28 of the connector may appear at the front of stem 33 surrounded by annular front face 34. A circular passageway 37 may be concentrically defined in the faceted drive head 32 at the rear of nut 30. Passageway 37 may be externally, coaxially bounded by the outer, round peripheral wall 38 forming a flat, circular end of the connector nut 30. An inner, annular shoulder 39 on the inside of head 32 is preferably spaced apart from and parallel with outer wall 38. A leading external, annular chamfer 40 and a spaced apart, rear external, annular chamfer 41 defined on N-sided, preferably hexagonal, head 32 are preferred.

Figure 8:
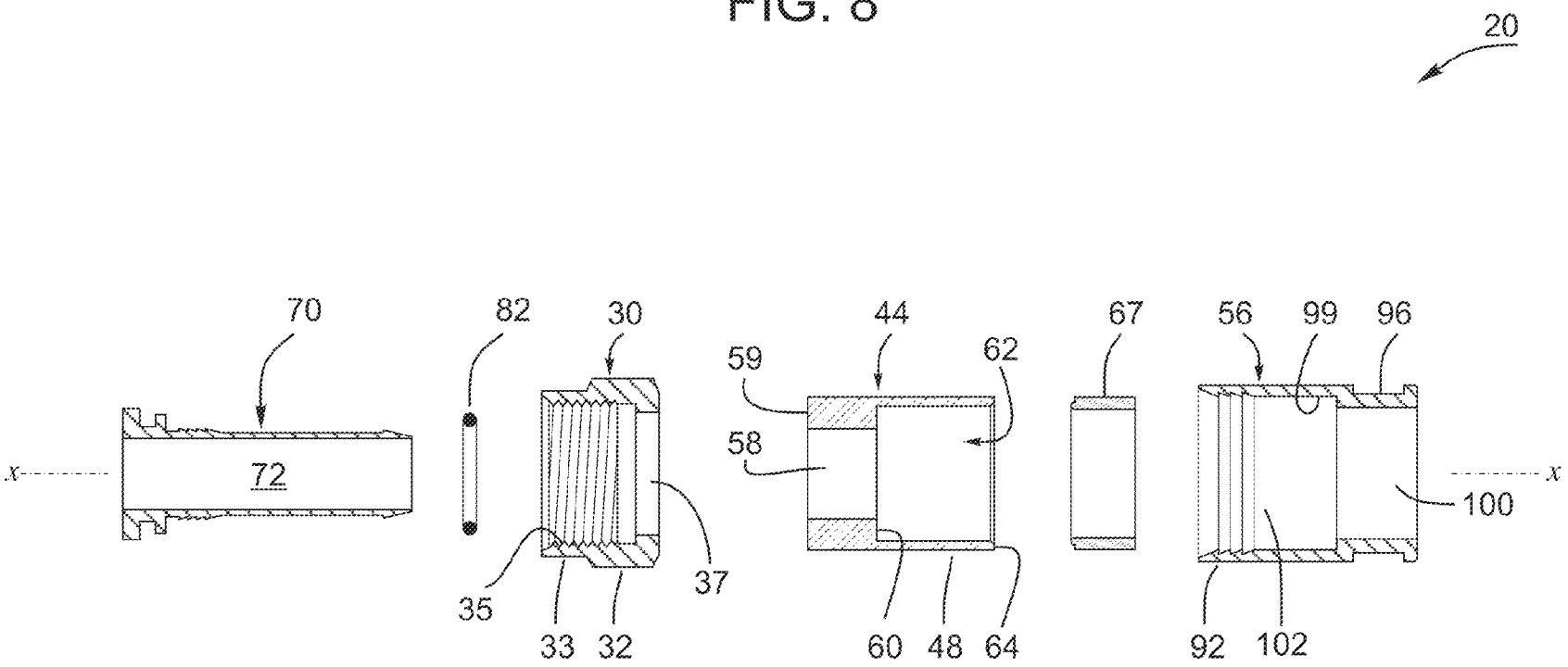
FIG. 8 is an exploded, longitudinal sectional view of the preferred connector without a torque sleeve.

An elongated, tubular body 44 formed from plastic or metal, is mounted adjacent nut 30. Body 44 preferably comprises a shank 48 sized to fit as illustrated in FIG. 8. The elongated, outer peripheral surface 52 of shank 48 may be smooth and cylindrical. The nut 30 rotates relative to the post and body and compression member.

In assembly, the end cap 56 is preferably pressed unto body 44, coaxially engaging the shank 48. In the preferred embodiment, the end cap 56 discussed hereinafter will smoothly, frictionally grip body 44 along and upon any point upon body shank 48. In other words, when the end cap 56 is compressed unto the body of either connector 20, 21, the connector 20, 21 may assume a closed position.

The body 44 is preferably hollow. Body 44 preferably has an internal, coaxial passageway 58 extending from the annular front face 59 defined at the body front to an inner, annular wall 60 that coaxially borders another passageway 62, which has a larger diameter than passageway 58. The elongated passageway 62 is preferably coaxially defined inside shank 48 and extends to annular rear, surface 63 coaxially located at the rear end 64 of the shank 48. The annular rear surface 63 of body 44 is preferably tapered proximate rear end 64 which generates a wedging action when the annular leading rear surface 65 contacts the grommet 67 when the connector 20 is compressed.

For moisture sealing, it is preferred that sealing grommet 67 be employed. The enhanced sealing grommet 67 is coaxially disposed within end cap 56. Grommet 67 is preferably made of a silicone elastomer.

Figure 9:
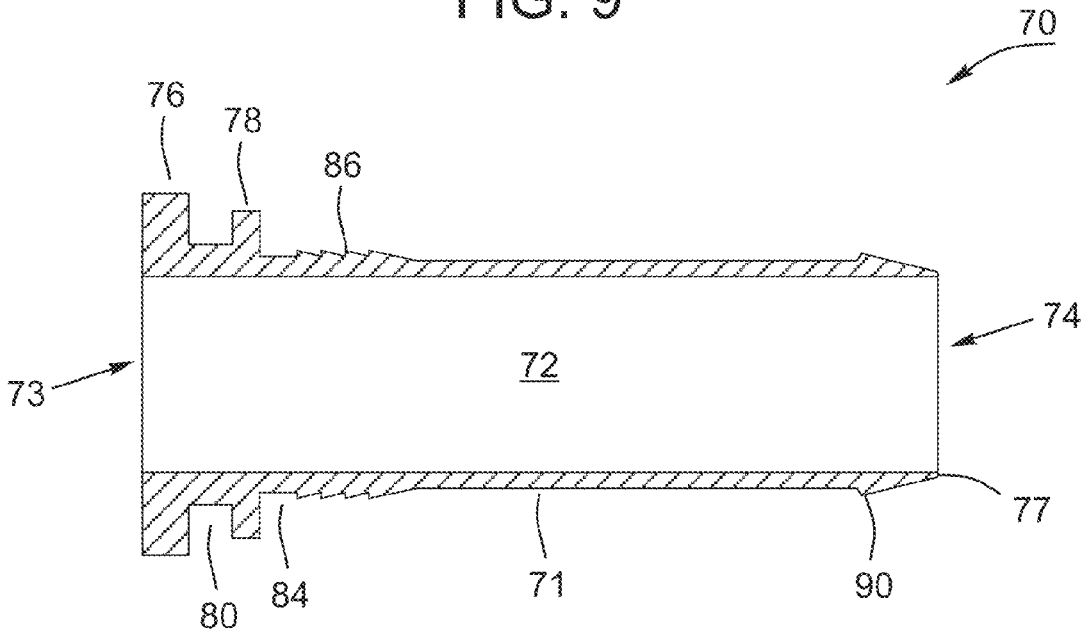
FIG. 9 is an enlarged, longitudinal sectional view of a post.
Figure 10:
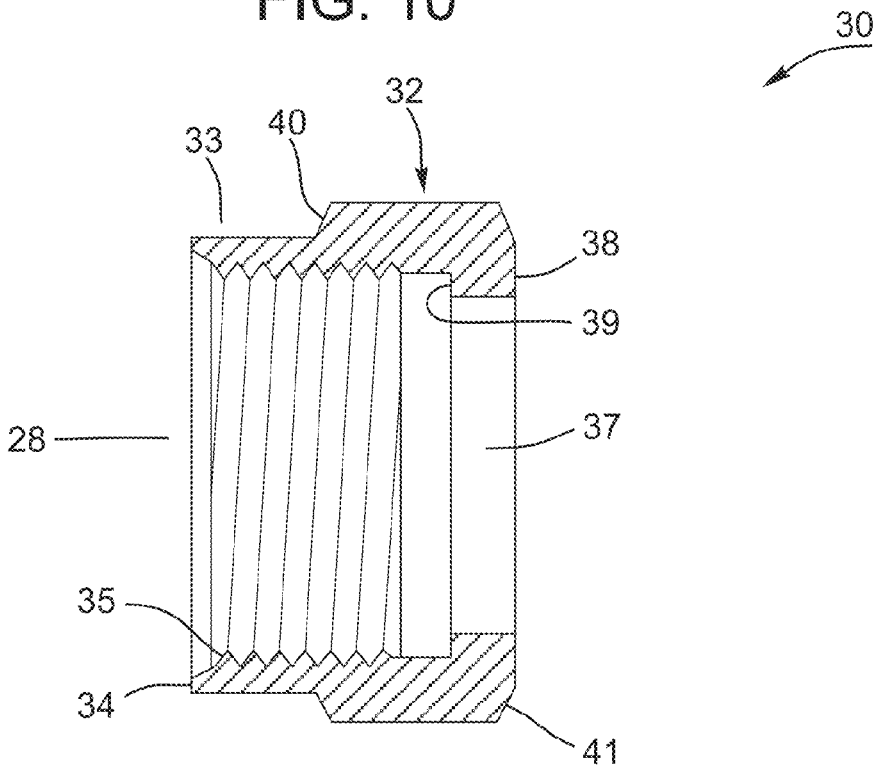
FIG. 10 is an enlarged, longitudinal sectional view of a nut.
Figure 11:
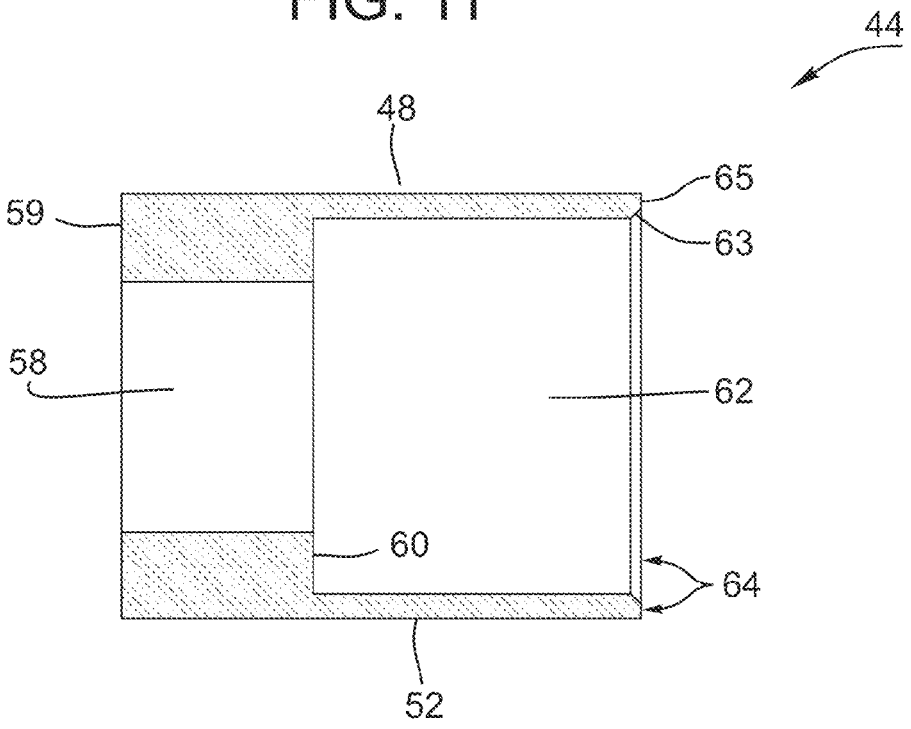
FIG. 11 is an enlarged, longitudinal sectional view of a preferred connector body.
Figure 12:
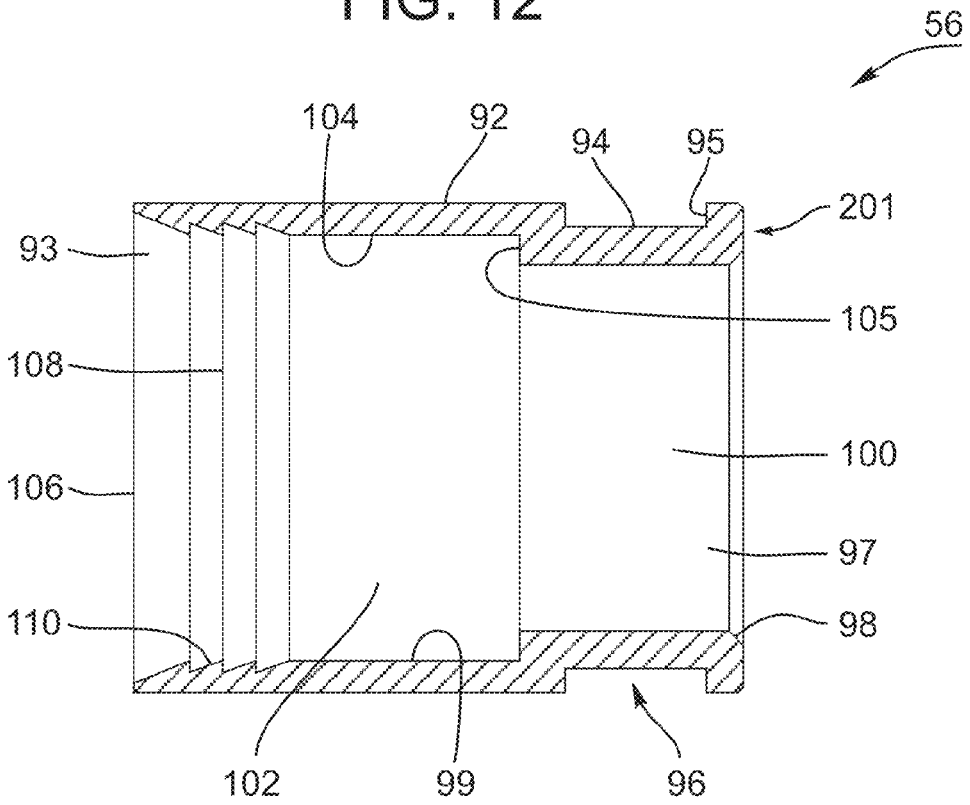
FIG. 12 is an enlarged, longitudinal sectional view of a preferred end cap.
Figure 13:
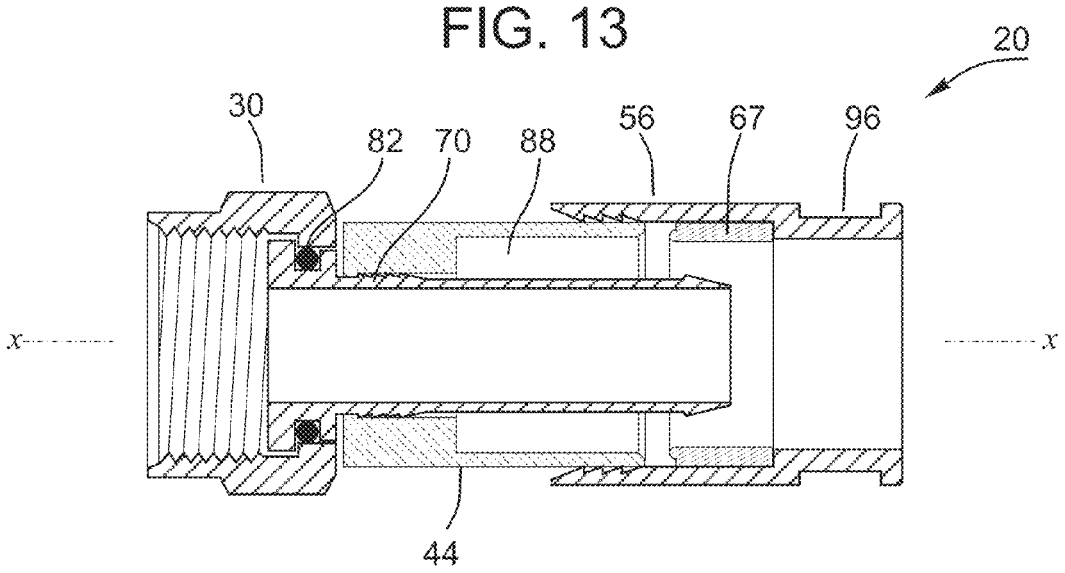
FIG. 13 is an enlarged, longitudinal sectional view of a preferred connector, shown in an uncompressed position, with no coaxial cable inserted and without a torque sleeve.
Figure 14:
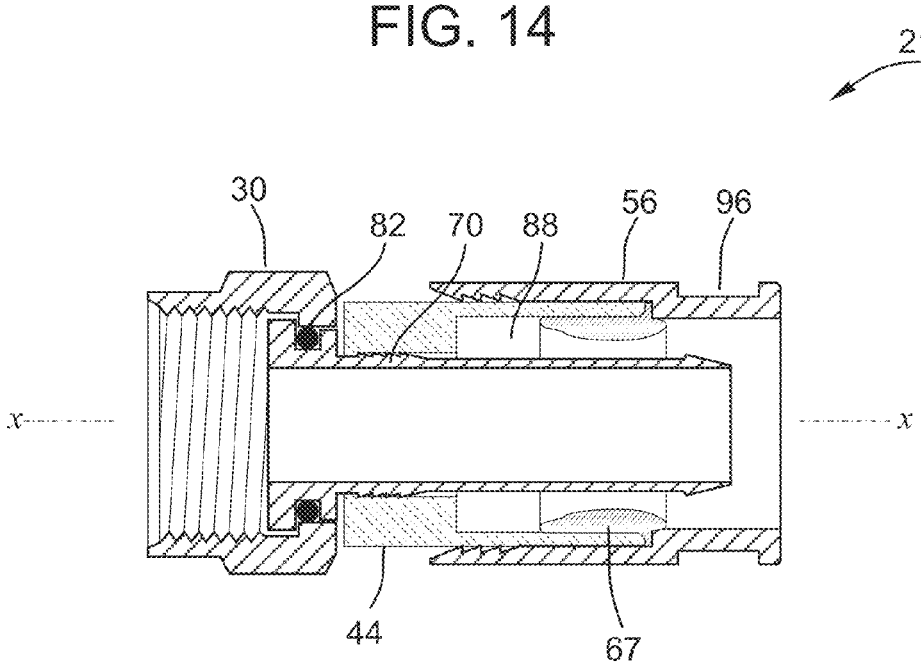
FIG. 14 is a longitudinal sectional view similar to FIG. 13, showing the connector the "closed" or compressed position, with no coaxial cable inserted.

With primary reference directed now to FIGS. 8 and 9, the post 70 rotatably, mechanically couples the N-sided, preferably hexagonal, nut 30 to the body 44. The metallic post 70 also preferably establishes electrical contact between the braid of the coaxial cable and the nut 30. The tubular post 70 preferably defines an elongated shank 71 with a coaxial, internal passageway 72 extending between its front 73 and rear 74. A front, annular flange 76 may be spaced apart from an integral, reduced diameter flange 78, across a preferred ring groove 80. A conventional, resilient O-ring 82 is preferably seated within ring groove 80 when the connector is assembled. A post collar region 86, preferably lacking serrations, may be press fitted into the body 44, frictionally seating within passageway 58. When a plastic body is used, serrations on post collar region 86 are preferred to improve frictionally seating within passageway 58. In assembly of the preferred embodiment, it is also noted that post flange 76 axially contacts inner shoulder 39 of nut 30. Inner post flange 78 axially abuts front face 59 of body 44 with post 70 penetrating passageway 58. The sealing O-ring 82 is preferably circumferentially frictionally constrained within nut 30 coaxially inside passageway 37.

It will be noted that the post shank 71 is substantially tubular, preferably with a smooth, outer shank surface extending to a tapered end 77. Shank may have one or more barbs 90 at the end 77 to engage the coaxial cable. The shank end 77 may penetrate the coaxial cable prepared end 116, such that the inner, insulated conductor penetrates post shank passageway 72 and coaxially enters the mouth 28 in nut 30. Also, the braided shield of the coaxial cable is coaxially positioned around the exterior of post shank 71, within annulus 88 coaxially formed within body passageway 62 between post 70 and the shank 48 of body 44.

The preferred end cap 56 is a rigid, preferably metallic end cap 56 comprising a tubular body 92 that may be integral and concentric with a rear neck 94 of reduced diameter. The neck 94 preferably terminates in an outer, annular flange 95 forming the end cap rear and preferably defining a coaxial cable input hole 97 with a beveled peripheral edge 98. In the preferred connector embodiments 20, 21, an external, annular ring groove 96 is concentrically defined about neck 94. The ring groove 96 may be axially located between body 92 and flange 95. The front of the end cap 56, and the front of body 92 may be defined by concentric, annular face 93. The external ring groove 96 is preferably readily perceptible by touch. Internal ring groove 99 may seat the preferred sealing grommet 67.

Hole 97 at the rear of end cap 56 may communicate with a cylindrical passageway 100 concentrically located within neck 94. Passageway 100 may lead to a larger diameter passageway 102 defined within end cap body 92. Ring groove 99 may be disposed between passageways 100 and 102. Passageway 102 is preferably sized to frictionally, coaxially fit over shank 48 of connector body 44 in assembly. In one embodiment, there is an inner, annular wall 105 concentrically defined about neck 94 and facing within large passageway 102 within body 92 that is a boundary between end cap body 92 and end cap neck 94. Grommet 67 may bear against wall 105 in operation. Once a prepared end of coaxial cable 116 is pushed through passageways 100, and 102 it preferably may expand slightly in diameter as it is axially penetrated by post 70.

The end cap 56 and the body 44 will each have maximal outer radii, which can be designated X and Y respectively. X can be greater than Y or Y can be greater than X. However, together, the end cap 56 and body 44 have a maximal outer radius, which is designated R. R is equal to the greater of X or Y. R represents the greatest radius a torque sleeve will have to clear in order to slide over the back of the connector to the nut 32.

In one embodiment, the deformed grommet 67 whose axial travel is resisted by internal wall 105 will be deformed and reshaped, "travelling" to the rest position assumed when compression is completed, as discussed below. After fitting compression of one embodiment, subsequent withdrawal of coaxial cable from the connector will be resisted in part by surface tension and pressure generated between the post shank and contact with the coaxial cable portions within it and coaxially about it.

Cap 56 may be firmly pushed unto the connector body 44 and then preferably axially forced a minimal, selectable distance to semi-permanently retain the end cap 56 in place on the body (i.e., coaxially frictionally attached to shank 48). There is no critical detented position that must be assumed by the end cap. The inner smooth cylindrical surface 104 of the end cap 56 may be defined concentrically within body 92. Surface 104 preferably coaxially, slidably mates with the smooth, external cylindrical surface 52 of the body shank 48. Thus the end cap 56 may be partially, telescopingly attached to the body 44, and once coaxial cable is inserted as explained below, end cap 56 may be compressed unto the body, over shank 48, until the coaxial cable end is grasped and the parts may be locked together. It is preferred however that the open mouth 106 at the end cap front have a plurality of concentric, spaced apart beveled rings 108 providing the end cap interior surface 104 with peripheral ridges resembling "teeth" 110 that firmly grasp the body shank 48. Preferably there are three such "teeth" 110.

When the end cap 56 is compressed to the body 44 in the preferred embodiment, it can firmly grasp the shank 48 and make a firm connection without radially compressing the connector body, which is not deformed in assembly in the preferred embodiment. In one embodiment, the end cap 56 may be compressed to virtually any position along the length of body shank 48 between a position just clearing annular surface 65 and the maximum deflection of the end cap 56.

It can be seen that when the end cap 56 is first coupled to the shank 48 of body 44 in a preferred embodiment, the shank end 64 (and annular surface 65) are axially spaced apart from the grommet 67 that is coaxially positioned within the rear interior of the end cap 56. However, when the connector 20 is compressed during installation, the grommet 67 is forced into and against the shank rear end 64, which deforms the grommet into annulus 88.

Figure 15:
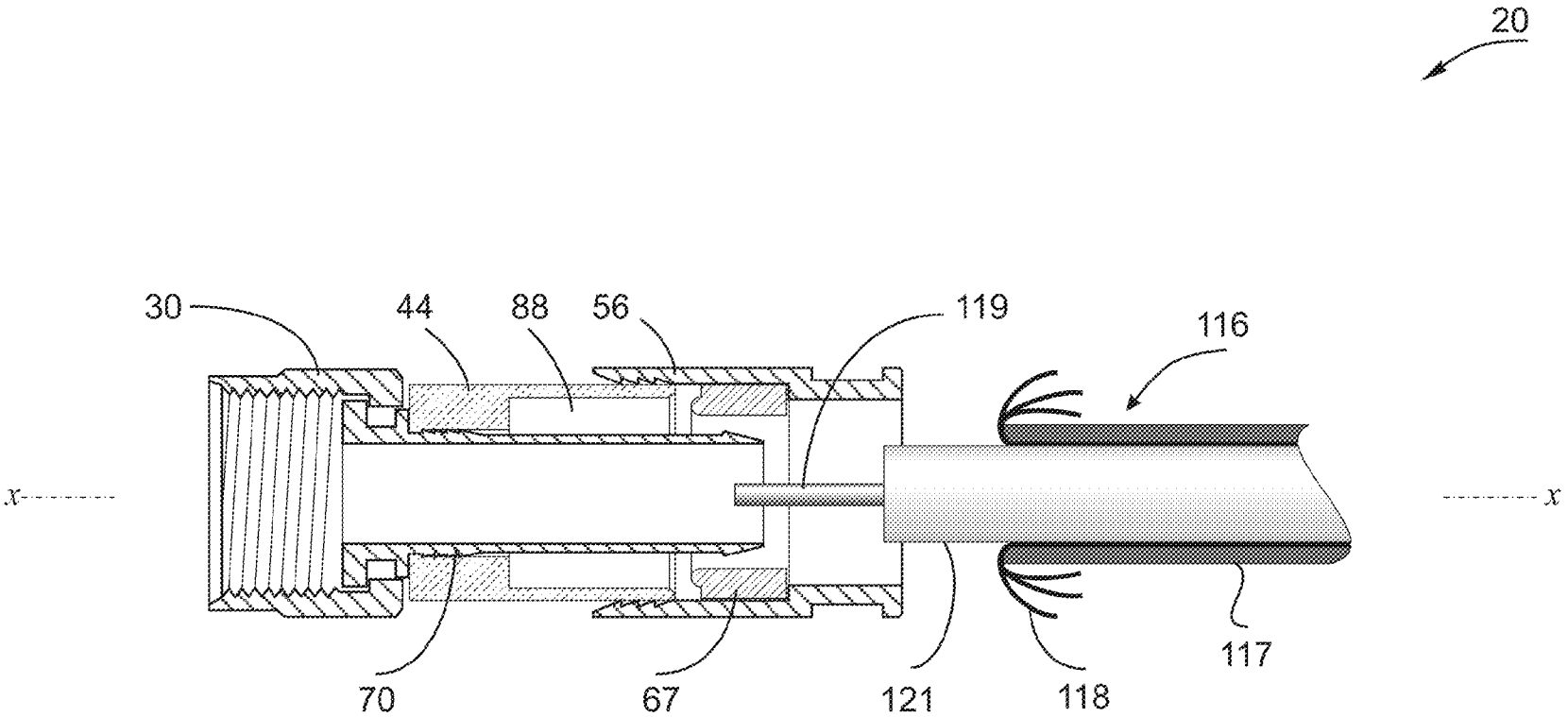
FIG. 15 is a view similar to FIG. 13, showing the connector in an open position, with a prepared end of coaxial cable inserted.
Figure 16:
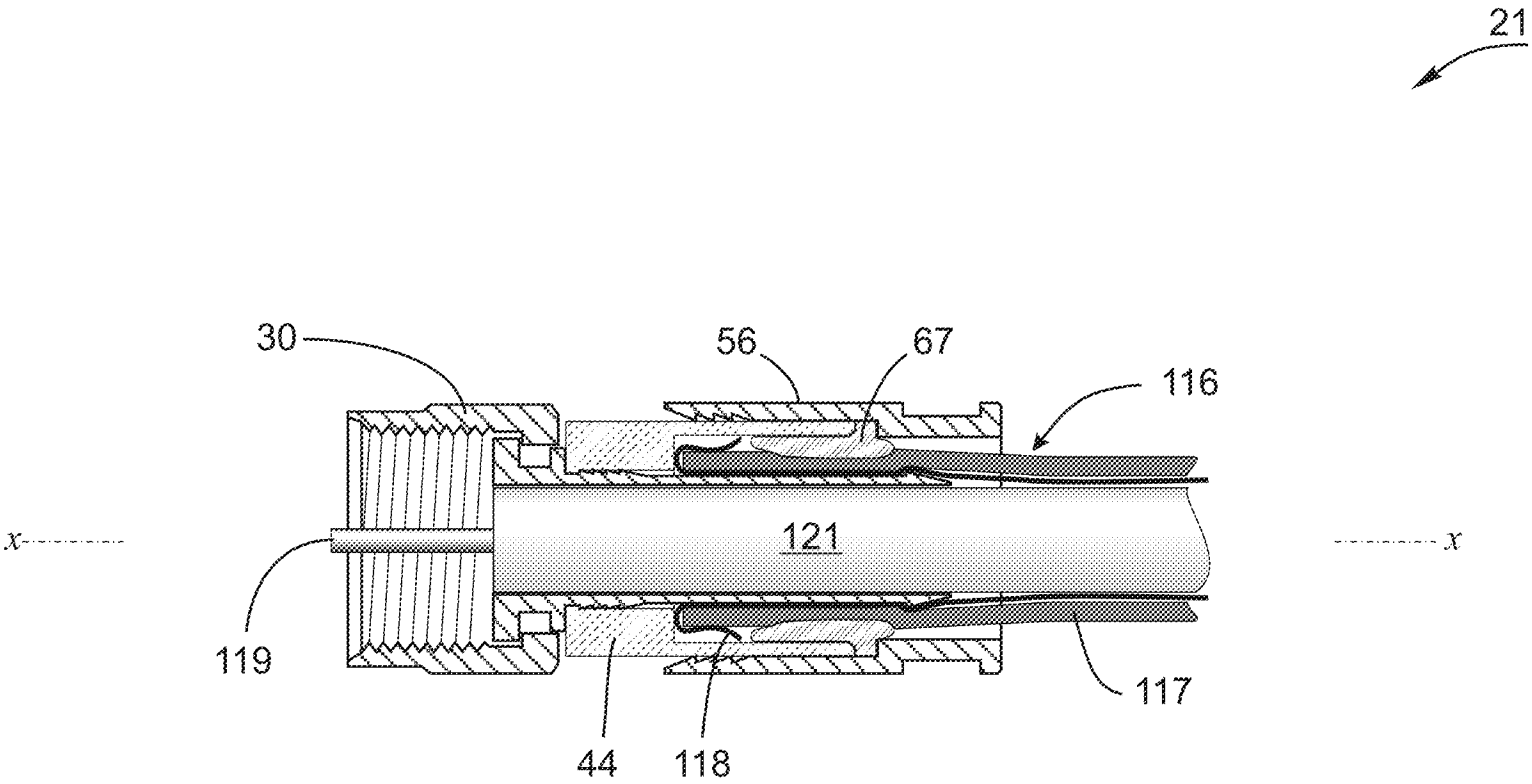
FIG. 16 is a view similar to FIG. 15, showing the connector in a compressed position.
Figure 17:
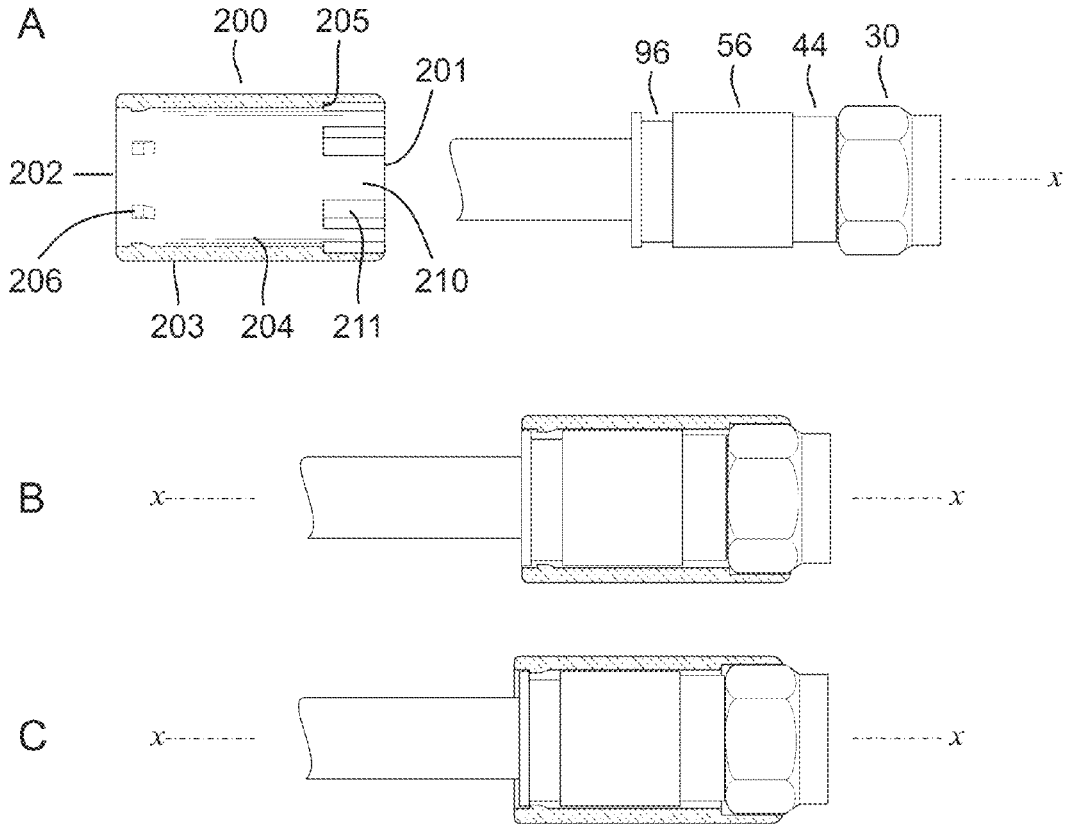
FIG. 17 is three views with A being a sectional view of a preferred torque sleeve before being positioned over a coaxial cable connector, with B being a sectional view of a preferred torque sleeve positioned over a coaxial cable connector, and with C being a sectional view of a preferred torque sleeve positioned over a coaxial cable connector.
Figure 18:
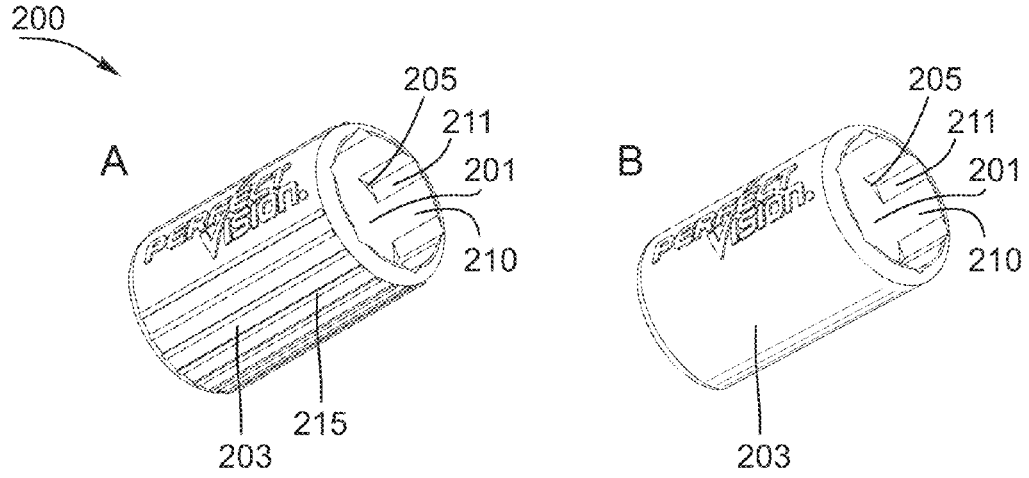
FIG. 18 is two views with A being a longitudinal isometric view of a preferred embodiment of a torque sleeve with splines and B being a longitudinal isometric view of a preferred embodiment of a torque sleeve without splines.

A prepared end of coaxial cable 116 is illustrated within the connector as can be seen in FIGS. 15 and 16. The coaxial cable 116 has an outermost, usually black-colored, plastic jacket 117 forming a waterproof, protective covering, a concentric braided metal sheath 118, and an inner, usually copper alloy conductor 119. There is an inner, plastic insulated tubular dielectric portion 121. When the prepared end is first forced through the connector rear, passing through end connector hole 97 and through passageways 100, 102, the end cap 56 is uncompressed. The coaxial cable prepared end can be forced through the annulus 88 between the post 70 and the inner cylindrical surface of shank 48 with post 70 preferably coaxially penetrating the coaxial cable between the conductive braid 118 and the dielectric insulation 121, with the latter coaxially disposed within the post. The prepared end of the coaxial cable preferably has its outer metallic braid 118 folded back and looped over insulative outer jacket 117. The metal braid or sheath makes electrical contact with the post 70 and, after full compression, contacts portions of the body.

Dielectric insulation 121 coaxially surrounds the innermost cable conductor 119, and both are preferably coaxially routed through the post. A portion of conductor 119 preferably protrudes into the mouth 28 of the nut 30 on the connector. Thus an end of conductor 119 forms the male portion of the F-connector 20, 21.

Figure 20:
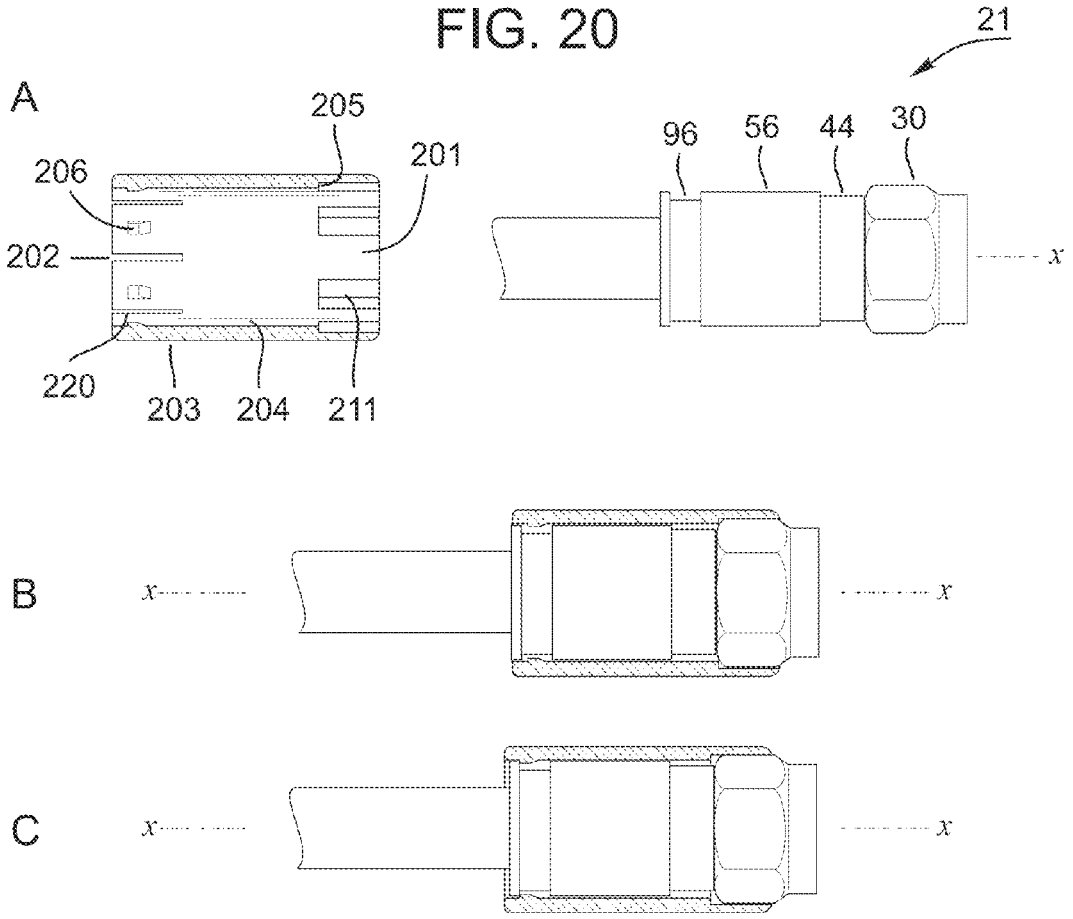
FIG. 20 is three views with A being a sectional view of a preferred torque sleeve with a plurality of slots in its rear end before being positioned over a coaxial cable connector, with B being a sectional view of a preferred torque sleeve with a plurality of slots in its rear end positioned over a coaxial cable connector, and with C being a sectional view of a preferred torque sleeve with a plurality of slots in its rear end positioned over a coaxial cable connector.
Figure 21:
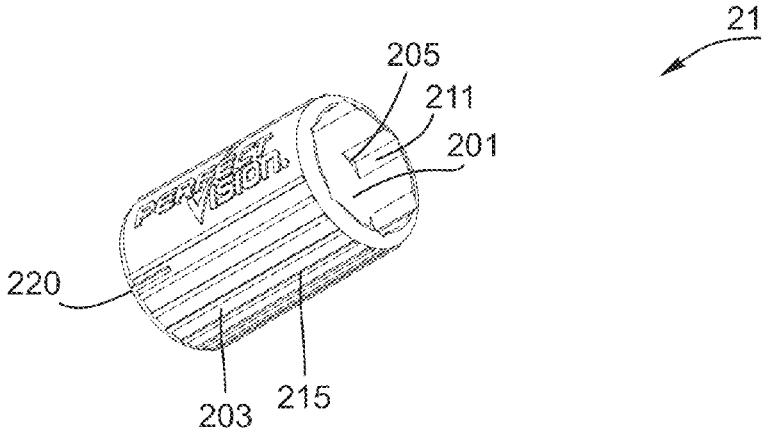
FIG. 21 is a longitudinal isometric view of a preferred torque sleeve having splines and slots in its rear end.

As can be seen in FIG. 20 preferably used grommet 67 deforms conductive braid 118 and plastic jacket 117 against shank 71 of the post 70. This deformation increases the contact surface area between the post 70 and the conductive braid 118 thereby increasing electrical contact and shielding. The increased contact surface between the grommet 67 and the plastic jacket 117, along with the deformation of the plastic jacket 117 preferably adds to the withdrawal strength necessary to pull the coaxial cable away from the compressed fitting.

Second, with reference to FIGS. 17-21, preferred embodiments of a torque sleeve will be described that may be used with some standard F-connectors, including the connectors described above.

In one embodiment, the torque sleeve 200 has a first end 201, a second end 202, an outer surface 203, and an inner surface 204. The inner surface 204 defines the bore of the torque sleeve, which is generally hollow.

The bore of the torque sleeve 200, at least at the first end 201, is dimensioned so that it can fit over a hypothetical F-connector with a maximal outer radius of R. In practicality, the maximal radius of the F-connector will be the maximal radius of the greater of the body or the endcap. In order for the bore of the torque sleeve 200, at least at the first end 201, to fit over such a hypothetical F-connector, the bore must have a radius of approximately R or greater than R for all points along the circumference of its inner surface at least at the first end 201.

Next, in order to engage with the N-sided nut, the bore of the torque sleeve 200 should have a radius of approximately S for at least N points on the inner surface, at least at the first end 201. This will allow at least the first end 201 to fit over the N-sided nut. Additionally, the bore of the torque sleeve 200 should have a radius less than S for at least 2N points on the inner surface, at least at the first end 201. These points, which are preferably on either side of the S-radius points, provide for engagement with the corners of the N-sided nut at least at the first end 201.

In one preferred embodiment of a torque sleeve (examples of which are depicted in FIGS. 17-21), the bore of the torque sleeve is conceptualized having a circular inner surface 210 at the first end creating a bore of approximately R. Then, N notches 211 (where N is preferably six) are cut into the inner surface at positions that are spaced apart to correspond to the N corners of the nut. The notches 211 are deep enough to make the radius of the bore approximately S at the deepest point of the notch. Thus, inner surface of the torque sleeve will take on a cross-sectional shape that is circular except for the N notches 211. In this way, this preferred embodiment of a torque sleeve (i) has a radius of approximately R or greater than R for all points along the circumference of its inner surface at least at the first end 201, (ii) has a radius of approximately S for at least N points on the inner surface, at least at the first end 201, and (iii) has a radius less than S for at least 2N points on the inner surface, at least at the first end 201.

The second end of the torque sleeve 202 does not necessarily need to have a bore with the same dimensioning described above for the first end 201. However, within the bore of the torque sleeve 200 it is preferable to have a means for locking the torque sleeve 200 into place over a standard F-connector, such as the ones described above. One such means first utilizes a means for preventing the torque sleeve 200 from sliding forward beyond the N-sided nut of the F-connector. This function can be accomplished by an area of reduced radius of the bore of the torque sleeve 200 at least at one point along its circumference at an axial position beyond the first end 201 and toward the second end 202. Preferably, one can use a retaining member configured to substantially prevent axial movement of the torque sleeve with respect to the coaxial cable connector at least in one (forward) direction. In one preferred embodiment, the means for preventing forward sliding can be a ridge 205 on the inner surface 204 of the torque sleeve 200. The ridge 205 is preferably annular, i.e., occurring at all points along the inner surface 204 of the torque sleeve 200. The ridge 205 is also preferably located at a position toward the second end 202 from the first end 201 approximately equal to the axial length of the N-sided nut. The ridge 205 also may not be annular, and instead located only behind one or more of the N notches. In some embodiments ridge 205 is perpendicular to the longitudinal axis of the connector. On other embodiments ridge 205 may have an orientation that is an acute or obtuse angle relative to the longitudinal axis and first end 201 of the torque sleeve, the angle being preferably between 45 and 135 degrees.

The means for locking the torque sleeve 200 into place over a standard F-connector would also include a means for preventing the torque sleeve 200 from sliding backward away from the N-sided nut of the F-connector once it has been put into position. This function can be accomplished by an area of reduced radius of the bore of the torque sleeve 200 at least at one point along its circumference at an axial position beyond the second end 202 and toward the first end 201. Preferably, this can be accomplished by a second ridge on the inner surface 204 of the torque sleeve 200 located closer to the second end 202 than the first ridge discussed above. Preferably, the second ridge is shaped so as to be ramped on the side facing the first end 201 and sheer on the side facing the second end 202. The second ridge can also be annular and would face toward the second end 202. In another preferred embodiment, the function can also be performed by one or more teeth 206 disposed along the inner surface 204 of the torque sleeve 200. Preferably, the teeth are shaped so as to be ramped on the side facing the first end 201 and sheer on the side facing the second end 202. Whether a second ridge or one or more teeth 206 are used, the means for preventing the torque sleeve 200 from sliding backward away from the N-sided nut of the F-connector once it has been put into position should be able to slide over the end of the end cap of one of the standard F-connectors discussed above and then "snap" or lock into place into, for example, the annular ring groove 96 of such an F-connector. The teeth 206 or ridge would then prevent the torque sleeve 200 from sliding backwards toward and off the second end 202.

In one preferred embodiment, shown in FIG. 20, the second end 202 of the torque sleeve 200 can have one or more slots 220 through it. This preferred embodiment is preferably used in conjunction with the embodiment using one or more teeth 206 disposed along the inner surface 204 of the torque sleeve 200. The slots facilitate the flexing of the second end 202 of the torque sleeve 200, specifically to allow the teeth 206 to flex over the end cap 56 more easily into place in the annular groove 96 of the F-connector. Preferably, the number of slots 220 will equal the number of teeth 206 and be placed midway between each set of two teeth 206. The use of slots 220 in conjunction with teeth 206 on the torque sleeve 200 allows for the use of radially larger teeth 206 than would otherwise be possible because they would otherwise be unable to fit over the end cap 56 of the F-connector.

In one embodiment, the inner surface 204 of the torque sleeve 200 may also comprise one or more continuity promoting members. Preferably, one such continuity promoting member would take the place of the ridge 205. Instead of one sided ridge 205, there can be constructed a thin two-sided resilient ridge. The distance between the thin, two-sided resilient ridge and the one or more teeth 206 (or the second ridge) could then be chosen such that the thin two-sided resilient ridge would exert a biasing force against the N-sided nut of one of the standard F-connectors described above. This biasing force would then ensure that a reliable grounding path exists between the N-sided nut and the post in the event that the grounding connection between the post and the interface port is disconnected due to inadequate tightening of the N-sided nut. The benefits and mechanics of ensuring this alternative grounding path are further discussed in U.S. Pat. Pub. 2013/0171870 A1 to Chastain et al., which is incorporated by reference herein in its entirety. However, it is believed that the present inventors have first discovered a way of enhancing grounding continuity using a member disposed on a torque sleeve as discussed above. As discussed above, the one or more continuity promoting members can be part of or separate from the structure that is also used as the means for locking the torque sleeve 200 into place.

Figure 19:
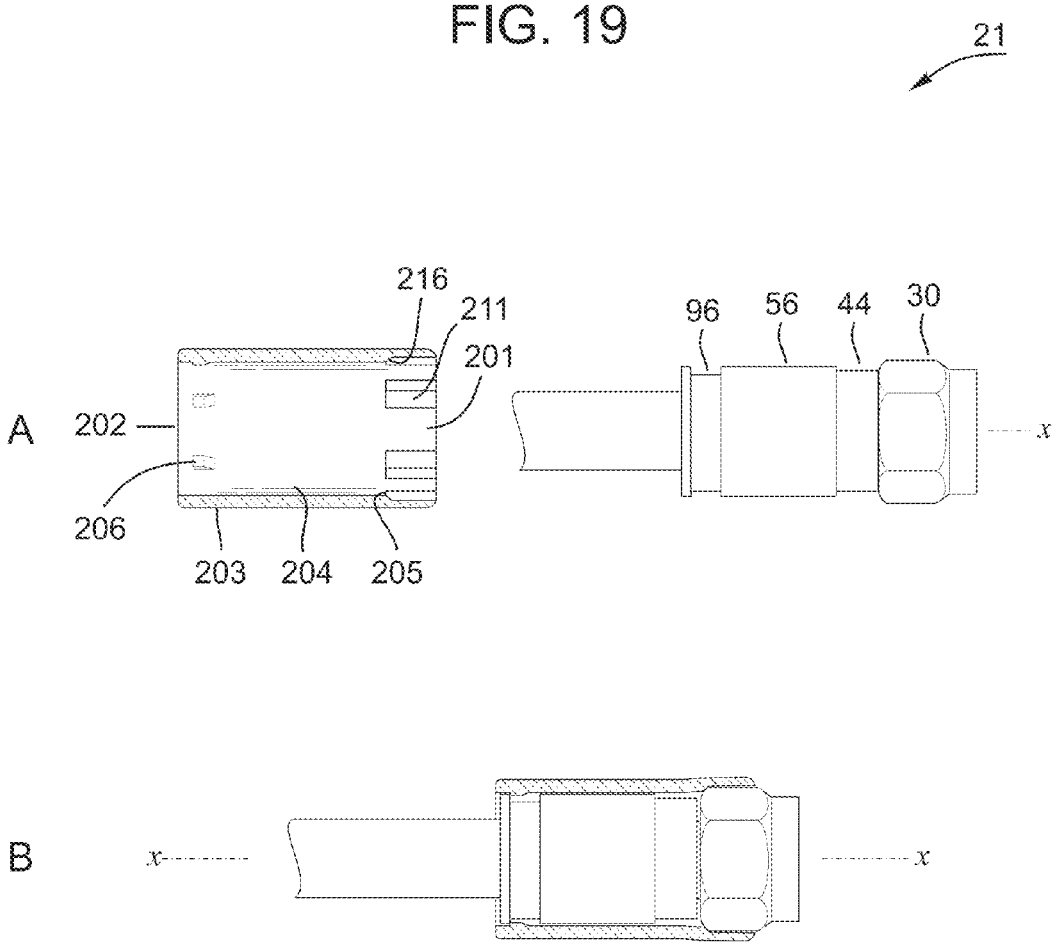
FIG. 19 is two views with A being a sectional view of a preferred torque sleeve with ramped notches to promote continuity before being positioned over a coaxial cable connector and with B being a sectional view of a preferred torque sleeve with ramped notches to promote continuity positioned over a coaxial cable connector.

In another preferred embodiment, the depth of the notches 211 may be ramped in order to improve grounding continuity between the interface port and the coaxial cable. A grounding path normally exists directly between the interface port and the post of the coaxial connector. However, at times, when the coaxial connector is not fully tightened onto the interface port, a gap can exist between the interface port and the post. In that event, it is important to establish an alternate grounding path. At a minimum, the interface port will always be in electrical contact with the nut, even when the coaxial connector is only partially threaded onto the interface port. Therefore, it is possible to maintain the grounding continuity by ensuring electrical contact between the nut and the post. This can be accomplished by using ramped notches 211, as shown in FIG. 19, wherein the radius of the torque sleeve at the deepest point of the notches 211 is decreased to less than S toward the second end 202 of the torque sleeve 200. In some embodiments, the ramping may begin at the first end 201 of the notch 211, and in other embodiments, the notch may be of uniform depth towards the first end 201 but then ramped toward the back-side of the notch. The notch 211 embodiment shown in FIG. 19 only has ramping toward the back-side of the notch. This ramping feature, in conjunction with the means for preventing the torque sleeve 200 from sliding forward beyond the N-sided nut of the F-connector (described below) will help promote continuity in the following way. When the torque sleeve is put into place over the nut, the ramped surface 216 of the notch 211 toward the second end 202 of the torque sleeve 200 will bias and push the nut forward into electrical contact with the post. The ramped notches 211 will flex outwardly, causing the angled surface of the ramped notches 211 to exert a biasing force with both inward and forward vectors. This biasing force, especially the forward vector of the biasing force, will ensure grounding continuity as discussed above.

The outer surface 203 of the torque sleeve 200 may be smooth, but is preferably given a texture or surface features that facilitate gripping and rotation by a hand. In one preferred embodiment the outer surface 203 of the torque sleeve 200 is knurled, grooved, or textured to facilitate gripping and/or rotation by a hand. In another preferred embodiment, the outer surface 203 of the torque sleeve 200 is given a plurality of splines 215 running axially along its surface. The splines 215 may be curved, angled, or rectilinear.

The present invention is also directed to an apparatus comprising one of the foregoing standard F-connectors assembled with one of the foregoing torque sleeves. Due to the innovative dimensioning and design of the foregoing torque sleeves, they can be assembled onto the F-connector by sliding the torque sleeve over the F-connector starting from its "back," i.e., end cap, side until the first end of the torque sleeve reaches and engages with the N-sided nut. If the torque sleeve comprises one of the means for locking the torque sleeve 200 into place over a standard F-connector described above, the torque sleeve may be slid over the F-connector until it locks in place.

Given that the end-cap end of the F-connector will have a coaxial cable protruding from it in the assembled state, assembly of the torque sleeve onto the F-connector usually takes place in the following way. First, the torque sleeve is slid over the prepared end of the coaxial cable, second end 202 first. Next, the F-Connector is assembled to the prepared end of the coaxial cable in the manner described above. Then, the torque sleeve is slid forward over the coaxial cable and into place on the F-connector as described above.

The foregoing torque sleeves are especially advantageous for use with coaxial "jumper" cables. A jumper cable, in this context, is a length of coaxial cable with a connector, preferably an F-connector, at either end. Jumper cables can be pre-assembled at the manufacturing stage and are thus an economical option for cable installers or consumers in need of only a short connection between two ports. The preferred jumper cable has two standard F-connectors, such as those described above, on either end of the length of coaxial cable.

A jumper cable according to the preferred embodiment of the present invention may be assembled as follows. First, there is provided a length of coaxial cable with two prepared ends. Two torque sleeves as described above are then slid over the length of coaxial cable, each with their first ends 201 facing toward the respective prepared ends of the length of coaxial cable. Then, two standard F-connectors are assembled onto the respective prepared ends of the length of coaxial cable in the manner described above. Finally, the two torque sleeves are slid respectively over each of the F-connectors and preferably locked into place and engaged with the F-connectors' respective N-sided nuts.

An F-connector assembled with a torque sleeve as described above can be easily connected to an interface port. To connect, the front end of the F-connector is held up to the interface port. A user then simply rotates the torque sleeve by hand in a clockwise direction to thread the N-sided nut onto the externally threaded interface port. An F-connector assembled with a torque sleeve as described above can also be easily disconnected from an interface port. To disconnect, a user simply rotates the torque sleeve by hand in a counterclockwise direction to de-thread the N-sided nut from the externally threaded interface port.

In some embodiments, the interface port will have a weather seal disposed around it. The torque sleeves of the present invention possess an additional advantage in that when an F-connector having a torque sleeve of the present invention is tightened into the interface port, the nut stem 33 is exposed to allow contact with the weather seal of the interface port, forming a another seal, to further prevent the ingress of water or debris between the interface port and the coaxial connector or into the coaxial connector.

It will be understood that certain features and subcombinations are of utility and may be employed without reference to other features and subcombinations. This is contemplated by and is within the scope of the claims. As many possible embodiments may be made of the invention without departing from the scope thereof, it is to be understood that all matter herein set forth or shown in the accompanying drawings is to be interpreted as illustrative and not in a limiting sense. Our invention is solely defined by the following claims.

We claim:

1. An apparatus comprising a torque sleeve configured to be disposed radially over a coaxial cable connector having (i) a body and an endcap with a maximal radius of R and (ii) an N-sided nut having N corners wherein the radius, S, of the N-sided nut is greater than R and the apothem, T, of the N-sided nut is less than R, wherein the torque sleeve comprises:

a first end;

a second end;

an outer surface; and an inner surface defining a bore;

wherein the bore, at least at the first end, has a radius of approximately R or greater than R for all points on the inner surface;

wherein the bore, at least at the first end, has a radius of approximately S for at least N points on the inner surface;

wherein the bore, at least at the first end, has a radius less than S for at least 2N points on the inner surface; and wherein the bore is configured to engage the corners of the N-sided nut such that the torque sleeve and the N-sided nut are rotatable together.

2. The apparatus according to claim 1 wherein the inner surface, at least at the first end, comprises at least N notches and wherein the at least N points on the inner surface for which the bore has a radius of approximately S correspond to the at least N notches.

3. The apparatus according to claim 2 wherein the inner surface has a circular cross section except for the at least N notches.

4. The apparatus according to claim 3 wherein the at least N notches do not extend to the second end.

5. The apparatus according to claim 4 wherein N equals six.

6. The apparatus according to claim 4 further comprising a retaining member configured to substantially prevent axial movement of the torque sleeve with respect to the coaxial cable connector at least in one direction.

7. The apparatus according to claim 6, wherein the retaining member is a ridge located behind at least one of the N notches.

8. The apparatus according to claim 7, wherein the ridge is ramped into the at least one of the N notches.

9. The apparatus according to claim 4 further comprising means for locking the torque sleeve into place over the coaxial cable connector.

10. The apparatus according to claim 9 wherein the means for locking the torque sleeve into place over the coaxial cable connector comprises a ridge and one or more teeth on the inner surface of the torque sleeve.

11. The apparatus according to claim 10 wherein the second end of the torque sleeve has one or more slots radially through the outer surface to the bore of the torque sleeve.

12. The apparatus according the claim 4 further comprising one or more continuity promoting members.

13. The apparatus according to claim 1 wherein the outer surface of the torque sleeve has a plurality of splines running axially along the outer surface.

14. An assembly comprising:

a coaxial cable connector comprising:

a N-sided nut having N corners, a radius S, and an apothem T and being adapted to threadably fasten the connector;

an elongated, hollow post comprising a portion that abuts the nut;

a hollow, tubular body radially disposed over the post; and an end cap adapted to be coupled to the body;

wherein the body and the end cap have a maximal radius R such that S is greater than R and T is less than R; and a torque sleeve disposed radially over the coaxial cable connector comprising:

a first end;

a second end;

an outer surface; and an inner surface defining a bore;

wherein the bore, at least at the first end, has a radius of approximately R or greater than R for all points on the inner surface;

wherein the bore, at least at the first end, has a radius of approximately S for at least N points on the inner surface; and wherein the bore, at least at the first end, has a radius less than S for at least 2N points on the inner surface;

wherein the bore of the torque sleeve engages the corners of the N-sided nut such that the torque sleeve and the N-sided nut are rotatable together.

15. The apparatus according to claim 14 wherein the inner surface, at least at the first end, comprises at least N notches and wherein the at least N points on the inner surface for which the bore has a radius of approximately S correspond to the at least N notches.

16. The apparatus according to claim 15 wherein the inner surface has a circular cross section except for the at least N notches.

17. The apparatus according to claim 16 wherein the at least N notches do not extend to the second end.

18. The apparatus according to claim 17 further comprising means for locking the torque sleeve into place over the coaxial cable connector.

19. The apparatus according to claim 18 wherein the means for locking the torque sleeve into place over the coaxial cable connector comprises a ridge and one or more teeth on the inner surface of the torque sleeve.

20. The apparatus according to claim 19 wherein the second end of the torque sleeve has one or more slots radially through the outer surface to the bore of the torque sleeve.

21. The apparatus according to claim 19, wherein the ridge is located behind at least one of the N notches.

22. The apparatus according to claim 21, wherein the ridge is ramped into the at least one of the N notches.

23. The apparatus according the claim 14 further comprising one or more continuity promoting members.

24. The apparatus according to claim 14 further comprising a sealing grommet disposed within the end cap.

25. The apparatus according to claim 19 wherein the one or more teeth lock into place in an annular ring groove on the coaxial cable connector.

26. A method of assembling an apparatus comprising the steps of:

(1) providing a coaxial cable connector comprising:

a N-sided nut having N corners, a radius S, and an apothem T and being adapted to threadably fasten the connector;

an elongated, hollow post comprising a portion that abuts the nut;

a hollow, tubular body radially disposed over the post; and an end cap adapted to be coupled to the body;

wherein the body and the end cap have a maximal radius R such that S is greater than R and T is less than R;

(2) providing a torque sleeve comprising:

a first end;

a second end;

an outer surface; and an inner surface defining a bore;

wherein the bore, at least at the first end, has a radius of approximately R or greater than R for all points on the inner surface;

wherein the bore, at least at the first end, has a radius of approximately S for at least N points on the inner surface; and wherein the bore, at least at the first end, has a radius less than S for at least 2N points on the inner surface;

(3) disposing the torque sleeve over a prepared end of a coaxial cable such that the first end of the torque sleeve faces the prepared end of the coaxial cable;

(4) assembling the coaxial cable connector with the prepared end of the coaxial cable after step (3);

(5) pushing the torque sleeve over the coaxial cable and the coaxial cable connector until the bore of the torque sleeve engages the corners of the N-sided nut such that the torque sleeve and the N-sided nut are rotatable together after step (4).

27. The method according to claim 26 further comprising the steps of repeating steps (1) to (5) for a second prepared end of the coaxial cable to assemble a jumper cable.

28. The method according to claim 27 wherein both torque sleeves are disposed over the coaxial cable before either coaxial cable connector is assembled with either prepared end of the coaxial cable.

29. The method according to claim 26 wherein the inner surface, at least at the first end, comprises at least N notches, wherein the at least N points on the inner surface for which the bore has a radius of approximately S correspond to the at least N notches, wherein the inner surface has a circular cross section except for the at least N notches, and wherein the at least N notches do not extend to the second end.

30. The method according to claim 29 wherein the torque sleeve further comprises means for locking the torque sleeve into place over the coaxial cable connector and wherein the method further comprises the step of locking the torque sleeve into place over the coaxial cable connector.

31. The apparatus according to claim 30 wherein the means for locking the torque sleeve into place over the coaxial cable connector comprises a ridge and one or more teeth on the inner surface of the torque sleeve.

32. The apparatus according to claim 31 wherein the second end of the torque sleeve has one or more slots radially through the outer surface to the bore of the torque sleeve.

33. The apparatus according to claim 31, wherein the ridge is located behind at least one of the N notches.

34. The apparatus according to claim 33, wherein the ridge is ramped into the at least one of the N notches.

* * * * *